US006069846A

United States Patent [19]

Nagata

[11] Patent Number: 6,069,846

[45] Date of Patent: May 30, 2000

[54] ELECTRONIC CLOCK

[75] Inventor: Yoichi Nagata, Tokorozawa, Japan

[73] Assignee: Citizen Watch Co., Ltd., Tokyo, Japan

[21] Appl. No.: 09/147,108

[22] PCT Filed: Feb. 6, 1998

[86] PCT No.: PCT/JP98/00511

§ 371 Date: Oct. 5, 1998

§ 102(e) Date: Oct. 5, 1998

[87] PCT Pub. No.: WO98/35272

PCT Pub. Date: Aug. 13, 1998

[30] Foreign Application Priority Data

Feb. 6, 1997 [JP] Japan ..... 9-023782
Nov. 27, 1997 [JP] Japan ..... 9-325574

[51] Int. Cl.[7] ..... G04B 1/00; G04B 9/00; G04C 3/00

[52] U.S. Cl. ..... 368/64; 368/66; 368/204

[58] Field of Search ..... 368/64, 66, 203, 368/204; 320/1, 2

[56] References Cited

U.S. PATENT DOCUMENTS 5,835,457 11/1998 Makajima ..... 368/204
5,943,301 8/1999 Igarashi ..... 368/204

FOREIGN PATENT DOCUMENTS 54-86374 7/1979 Japan .
61-236326 10/1986 Japan .
63-7388 1/1988 Japan .
6-31725 4/1994 Japan .
8-262161 10/1996 Japan .
9-15352 1/1997 Japan .

*Primary Examiner*—Vit Miska
*Attorney, Agent, or Firm*—Armstrong, Westerman, Hattori, McLeland & Naughton

[57] ABSTRACT

An electronic watch comprises electric power generator (10) for generating electric energy from external energy, electric power storage means (30) for storing the electric energy generated, and clock means (20) for executing time display operation by use of the electric energy supplied from the electric power generator (10) or electric power storage means (30). The electronic watch is further provided with arithmetic means (80) for calculating a ratio of a voltage generated by the electric power generator (10) to a voltage of the electric energy stored by the electric power storage means (30), switching circuit (40) for executing connection or disconnection among the electric power generator (10), electric power storage means (30), and clock means (20), and controller (50) so that connection or disconnection within the switching circuit (40) can be controlled by controller (50) according to the ratio as calculated by the arithmetic means (80).

19 Claims, 12 Drawing Sheets

ELECTRONIC CLOCK

TECHNICAL FIELD

The present invention relates to an electronic watch incorporating electric power generator for generating electric energy by utilizing externally available energy, and particularly, to an electronic watch having a function of storing the electric energy generated for use in driving the same.

BACKGROUND TECHNOLOGY

As conventional electronic watches, there are electronic watches provided with built-in electric power generator for converting external energy such as photovoltaic energy, mechanical energy, or the like into electric energy so that the electric energy can be utilized as driving energy for executing time display operation.

Among such electronic watches provided with the built-in electric power generator, there are included a solar cell watch using a solar cell, a mechanical electric power generation watch for utilizing electric energy converted from mechanical energy generated by rotation of a rotary weight, and a temperature difference electric power generation watch for generating electric power by utilizing the difference in temperature between the opposite ends of each of integrated thermocouples.

It is essential for these electronic watches provided with the built-in electric power generator to have built-in means for storing external energy therein while it is available so that the watch is driven continuously and stably all the time even after the external energy is gone.

For this reason, an electronic watch with a charging function, incorporating means for storing external energy therein, has been disclosed in, for example, Japanese Patent Laid-open Publication H 6-31725. An outline of circuits in the vicinity of a power supply source of the electronic watch is described with reference to FIG. 13.

An electric power generator 10, which is a solar cell, a first diode 11 and a capacitor 23 of small capacitance form a closed circuit, and further, a clocking block 24 for executing time display operation by use of electric energy and the capacitor 23 are connected in parallel. The electric power generator 10, a second diode 12, first switch 13, and secondary power source 31 form another closed circuit. A second switch 14 interconnects the positive source of the capacitor 23 and that of the secondary power source 31 in such a way as to connect the capacitor 23 and the secondary power source 31 in parallel.

Further, a first voltage comparator 16 controls the first switch 13 by comparing the terminal voltage of the capacitor 23 with a predetermined threshold value, and a second voltage comparator 17 controls the second switch 14 by comparing the terminal voltage of the secondary power source 31 with that of the capacitor 23.

In this electronic watch, as soon as electric energy is generated by the electric power generator 10, the capacitor 23 is immediately charged with electric energy, and the clocking block 24 is actuated by the electric energy stored in the capacitor 23.

When the terminal voltage of the capacitor 23 reaches a predetermined level or a level higher than that, the first switch 13 is closed by the agency of the first voltage comparator 16, and the secondary power source 31 is charged with the electric energy generated by the electric power generator 10.

When electric energy is not generated by the electric power generator 10, the terminal voltage of the capacitor 23 declines due to consumption of the electric energy by the clocking block 24, but when the terminal voltage of the secondary power source 31 is compared with that of the capacitor 23 by the second voltage comparator 17, and found to be higher than the latter, the second switch 14 is closed, thereby enabling continued operation of the clocking block 24 by the electric energy stored in the secondary power source 31.

The terminal voltage of the secondary power source 31, however, varies depending on the amount of electric energy stored, and with reference to a generated voltage of the electric power generator 10, there will arise a problem of the generated voltage undergoing changes depending on an external environment in the case of such an electric power generation device as represented by a thermoelectric device although there will arise no problem with a constant-voltage power-generation device such as a solar cell generating a substantially constant voltage all the time.

For example, in the circuit diagram in FIG. 13, wherein electric energy is generated by the electric power generator 10, if there exists a relationship of (terminal voltage of the secondary power source 31)

<(terminal voltage of the capacitor 23)

<(threshold value of the first voltage comparator 16)

and the generated voltage of the electric power generator 10 is higher than that of the secondary power source 31, the second switch 14 as well as the first switch 13 are controlled to be turned off even though the electric power generator 10 is capable of charging the secondary power source 31. As a result, the secondary power source 31 will not be charged with the result that effective use of the electric energy generated can not be made.

Accordingly, when the terminal voltage of the secondary power source 31 is relatively low, and the generated voltage is not so high, a charging operation is not executed, resulting in poor charging efficiency.

This is because the decision on whether or not the electronic watch is in a condition to be able to charge the secondary power source 31 is made only on the basis of the threshold value of the first voltage comparator 16.

It is therefore an object of the invention to solve the problem described above so that the charging operation of the electric energy storage means can be executed efficiently even if the terminal voltage of the electric power generator or the electric power storage means undergoes changes.

DISCLOSURE OF THE INVENTION

To this end, an electronic watch according to the invention comprises electric power generator for generating electric energy from external energy, electric power storage means for storing the electric energy generated by said electric power generator, clock means for executing time display operation by use of the electric energy supplied from said electric power generator or electric power storage means, arithmetic means for computing a ratio of a voltage generated by said electric power generator to a voltage of the electric energy stored by said electric power storage means, switching circuit for executing connection or disconnection among said electric power generator, electric power storage means, and clock means, and controller for controlling connection or disconnection within said switching circuit according to an arithmetic output delivered by said arithmetic means.

This enables a decision to be made on whether or not electric energy generated by the electric power generator is in a state to be able to charge the electric power storage means by calculating the ratio of the voltage generated by the electric power generator to the voltage of the electric energy stored by the electric power storage means with the use of the arithmetic means in whatever state the voltage generated and the voltage of the electric energy stored may be, and also enable the switching circuit to be controlled so as to charge the electric power storage means when charging is possible. Accordingly, such arrangement as described can prevent occurrence of a case where charging cannot be executed in spite of the potential ability of the electric power storage means to be charged as encountered in the case of conventional electronic watches, thus enabling the electric power storage means to be charged with electric energy efficiently.

The electronic watch according to the invention may further comprise booster means for boosting the voltage generated by the electric power generator at any of a plurality of boosting ratios, and supplying a boosted voltage to the electric power storage means and clock means, switching circuit for executing connection or disconnection among the electric power generator, electric power storage means. clock means, and booster means, and control means for controlling connection or disconnection within the switching circuit according to an arithmetic output delivered by the arithmetic means and controlling the boosting ratio of the booster means.

In this way, the charging operation of the electric power storage means can be executed more efficiently as it has become possible to utilize generated electric energy at a low voltage by boosting the voltage at an appropriate boosting ratio. which has been difficult to achieve in the case of conventional electronic watches.

In the case of charging at a boosting voltage, the charging efficiency of the electric power storage means can be further improved by selecting a boosting ratio at which the charging efficiency is maximized.

In view of this, if the charging means is capable of boosting a voltage, for example, onefold, twofold, and threefold, it is desirable to have a construction wherein the control means is capable of controlling the booster means so as to select onefold boosting if the ratio of the voltage generated by the electric power generator to the voltage of electric energy stored by the electric power storage means (voltage generated/voltage stored) is not less than 3/2, twofold boosting if the ratio is less than 3/2 but not less than 5/6, and threefold boosting if the ratio is less than 5/6 but not less than 1/3, respectively, while inhibiting a boosting operation if the ratio is less than 1/3.

It is also desirable that the electronic watch according to the invention be provided with applied voltage detector for detecting a voltage applied to the clock means to enable the controller to control the switching circuit such that if a voltage applied is less than a predetermined voltage value, an output from the booster means is sent to the clock means, and if the voltage applied is more than a predetermined voltage value, the output from the booster means is sent to the electric power storage means.

Further, the controller may be constructed so as to be able to control selection of a boosting ratio of the booster means according to an arithmetic output delivered by the arithmetic means, and also to control the switching circuit such that if the voltage generated is lower than a predetermined voltage, a boosting operation by the booster means is forcibly stopped by nullifying operation or arithmetic results of the arithmetic means, and connection between the electric power generator and charging means is cut off.

Otherwise, the controller may be constructed so as to control selection of a boosting ratio of the booster means according to an arithmetic output delivered by the arithmetic means, and also to control the switching circuit such that if the voltage generated is higher than a predetermined voltage and the voltage stored is lower than a predetermined voltage, the boosting ratio of the booster means is set at a fixed value by nullifying operation or arithmetic results of the arithmetic means, and the electric power storage means is charged at a boosting voltage.

It is desirable in this case that the boosting ratio of the booster means is set at a fixed value at which a voltage sufficient to drive the clock means can be obtained.

The arithmetic means described above may comprise first voltage divider for dividing the terminal voltage of the electric power generator at one or more voltage division ratios and outputting a first divided voltage, second voltage divider for dividing the terminal voltage of the electric power storage means at one or more voltage division ratios and outputting a second divided voltage, and comparator for comparing magnitude of the output of the first voltage divider with that of the second voltage divider and outputting a comparison result.

Further, the arithmetic means may intermittently execute an operation to calculate the ratio of the voltage generated to the voltage of electric energy stored by the electric power storage means.

It is desirable for the controller to have a function of controlling the switching circuit so as to cut off connection between the electric power generator and electric power storage means during operation by the arithmetic means.

It is also desirable that in the case where the electronic watch is provided with the booster means, the controller have a function of controlling the switching circuit such that during operation by the arithmetic means and for a given period of time immediately before the operation, the operation of the booster means is stopped, or connection between the electric power generator and booster means is cut off.

BEST MODE FOR CARRYING OUT THE INVENTION

Embodiments of an electronic watch according to the invention will be described in detail hereinafter with reference to the accompanying drawings.

Figure 1:
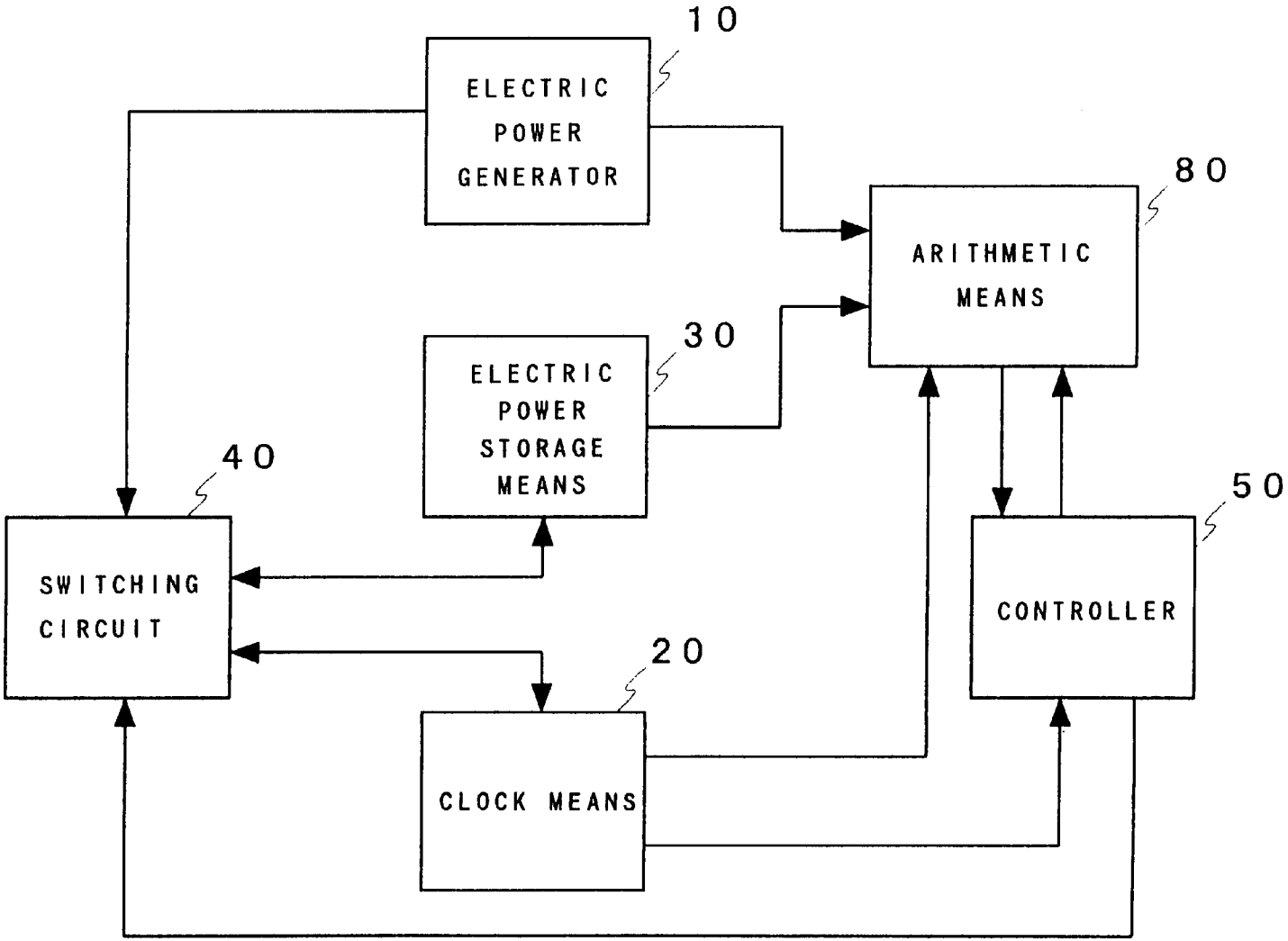
FIG. 1 is a block schematic diagram showing the basic construction of an electronic watch according to the invention.

Basic Construction of the Electronic Watch According to the Invention: FIG. 1

First, the basic construction of the electronic watch according to the invention is described referring to FIG. 1.

As shown in FIG. 1, the electronic watch according to the invention comprises electric power generator 10 for generating electric energy from external energy, electric power storage means 30 for storing the electric energy thus generated, clock means 20 for executing time display operation by use of the electric energy supplied by the electric power generator 10, or the electric power storage means 30, arithmetic means 80 for performing calculation of a ratio of a voltage generated by the electric power generator 10 to a voltage of the electric energy stored by the electric power storage means 30, switching circuit 40 for executing connection or disconnection among the electric power generator 10, the electric power storage means 30, and clock means 20, and controller 50 for controlling connection or disconnection of the switching circuit 40 according to an arithmetic output of the arithmetic means 80.

The electric energy generated by the electric power generator 10 is delivered to the electric power storage means 30 and clock means 20 via the switching circuit 40. Further, the arithmetic means 80 receives a generated voltage, that is, a terminal voltage of the electric power generator 10, and a stored voltage, that is, a terminal voltage of the electric power storage means 30, and performs calculation of a voltage ratio of the generated voltage to the stored voltage, that is, (the generated voltage/the stored voltage), sending the arithmetic output to the controller 50.

The controller 50 receives a basic signal for operation from the clock means 20, and the arithmetic output (the voltage ratio) of the arithmetic means 80, thereby controlling connection or disconnection of the switching circuit 40 as well as the operation of the arithmetic means 80.

With the construction as described above, an operation to charge the electric power storage means 30 is not executed in the case where the voltage ratio of the generated voltage of the electric power generator 10 to the stored voltage of the electric power storage means 30 is found to be outside a predetermined range, while the charging operation is executed when the voltage ratio is within the predetermined range so that even when the generated voltage of the electric power generator 10 is relatively low, the operation to charge the electric power storage means 30 can be executed.

The construction and operation of the electronic watch according to the invention is described in more detail with reference to respective embodiments mentioned hereinafter.

Figure 2:
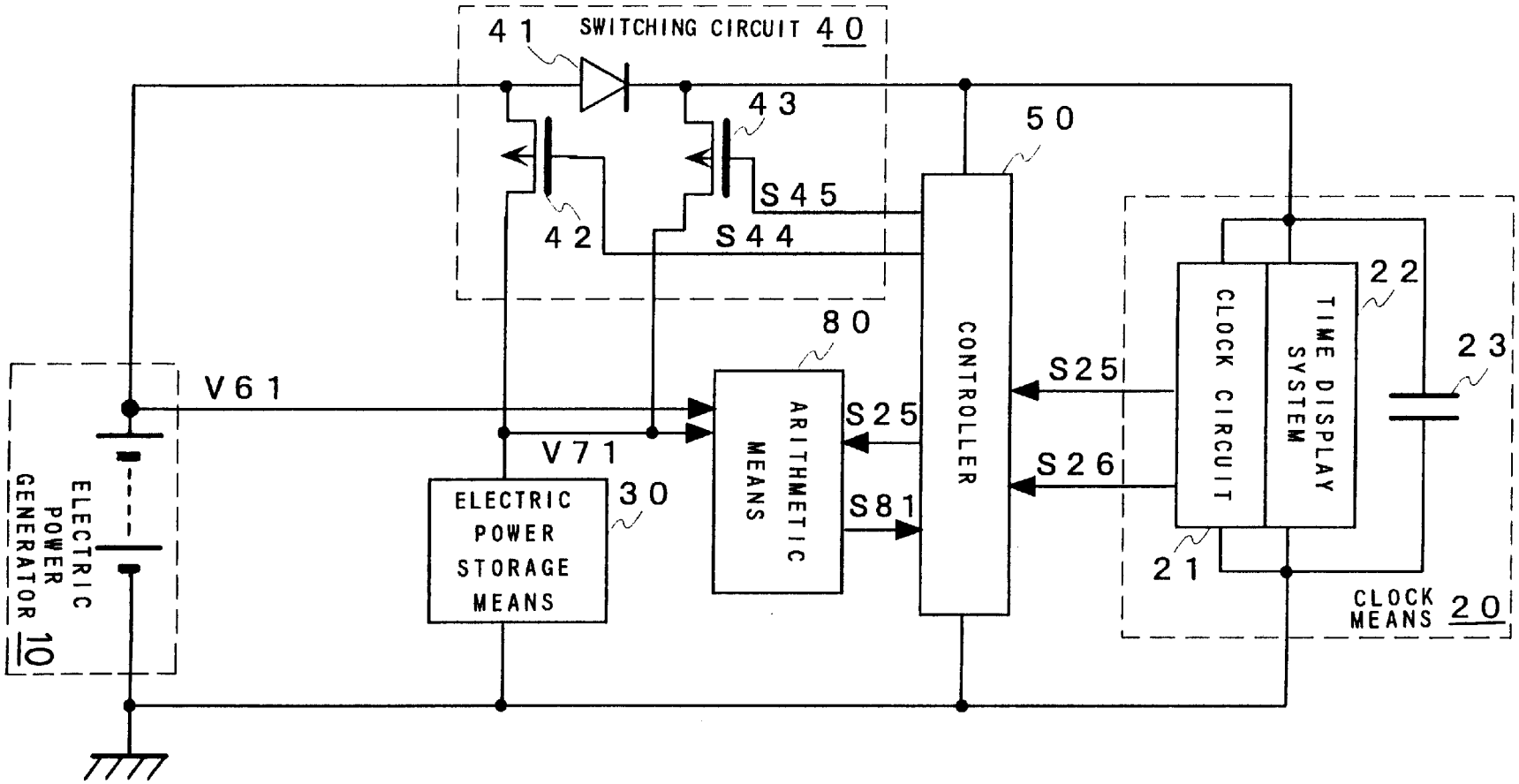
FIG. 2 is a block diagram showing the general construction of an electronic watch according to a first embodiment of the invention.
Figure 3:
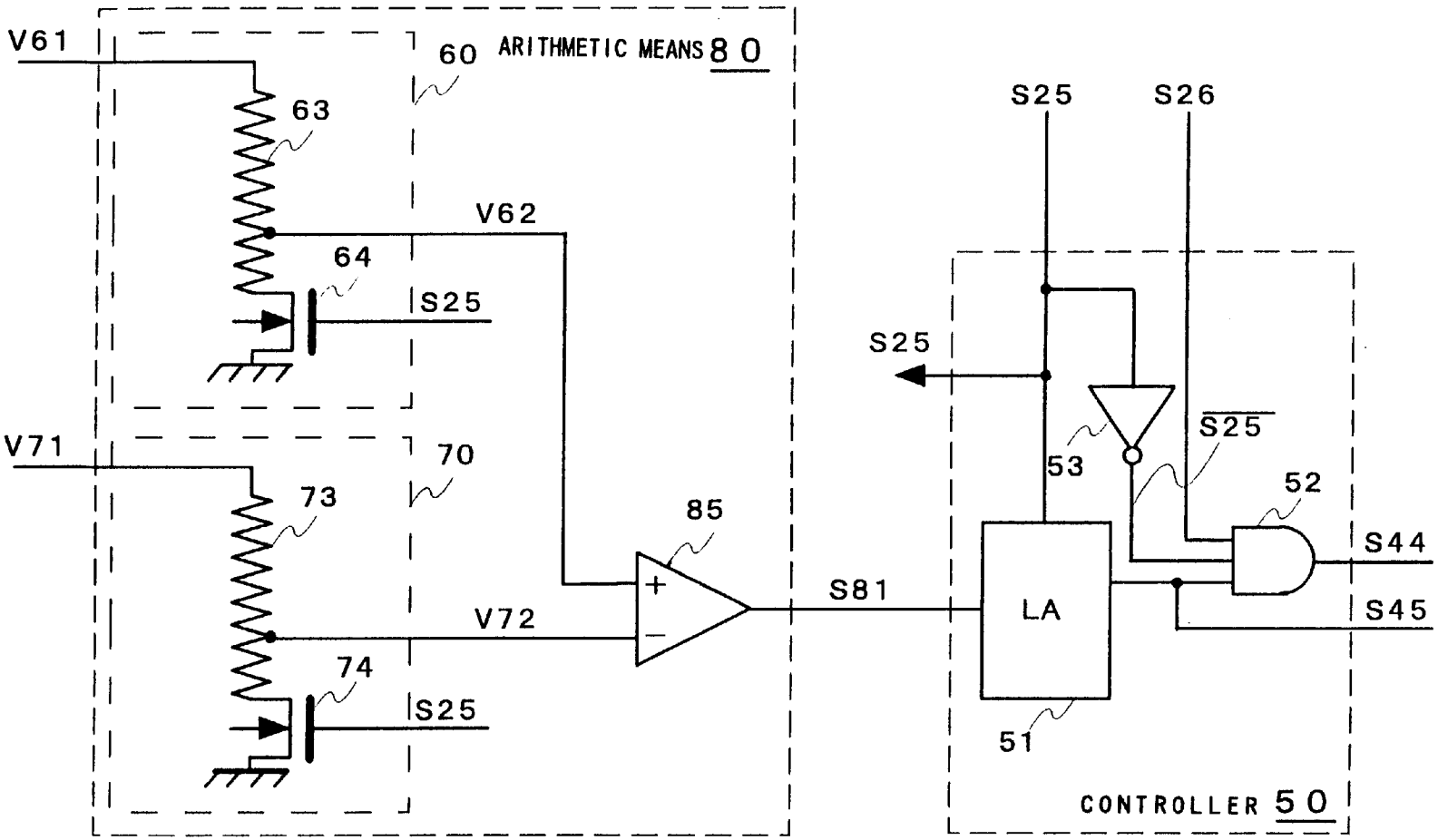
FIG. 3 is a circuit diagram showing an example of a specific circuit construction of arithmetic means and that of controller, shown in FIG. 2.
Figure 4:
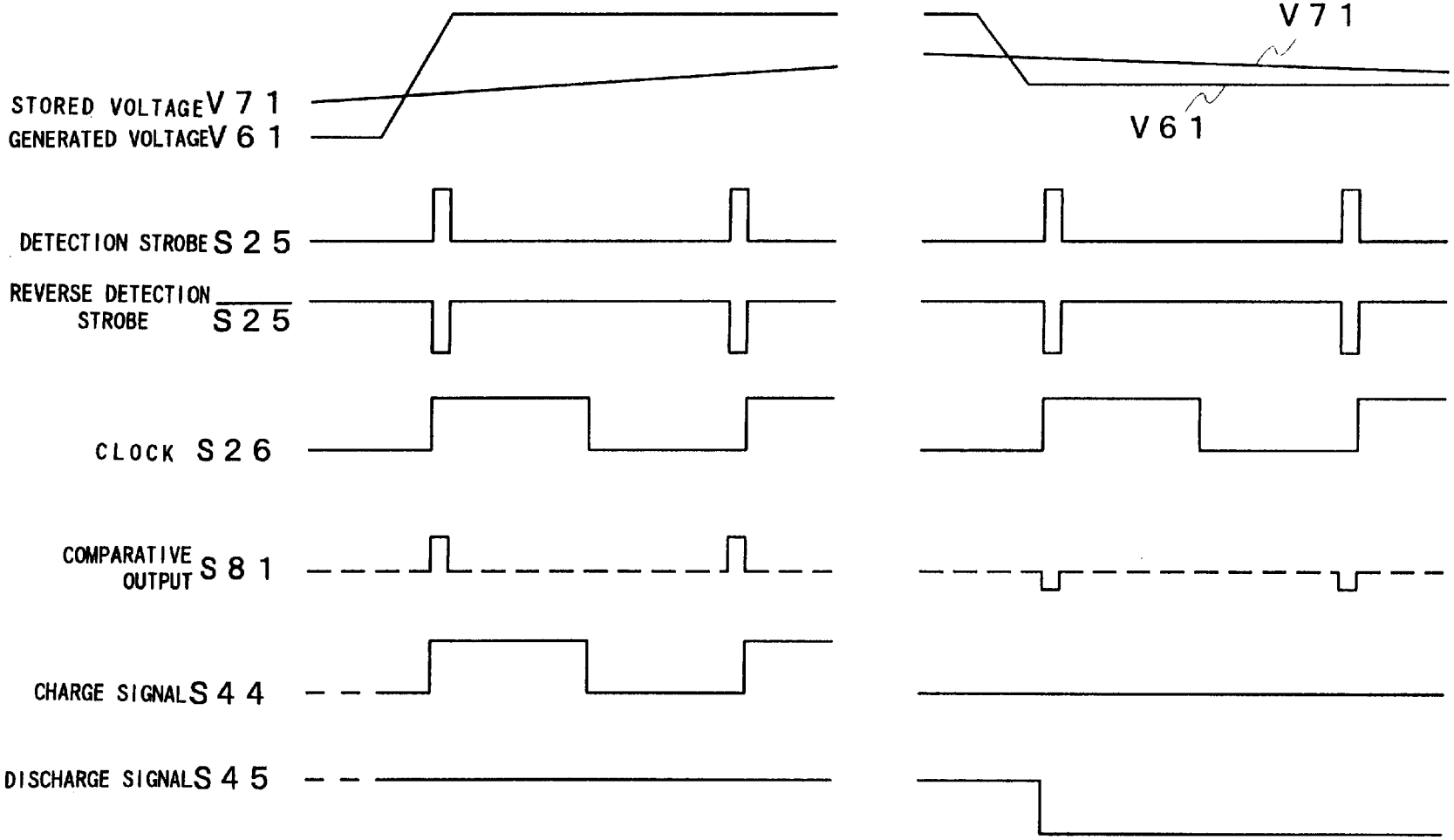
FIG. 4 is a waveform chart of signals from respective components of the electronic watch, shown in FIGS. 2 and 3.

First Embodiment: FIGS. 2 to 4

A first embodiment of the electronic watch according to the invention is described in detail with reference to FIGS. 2 to 4.

FIG. 2 is a block diagram showing the general construction of the electronic watch according to the first embodiment.

Electric power generator 10 is an electric power generation device block for converting external energy into electric energy, using for example, a thermoelectric device for generating electric power by providing a difference in temperature between the opposite ends of each of integrated thermocouples.

In this case, the electric power generator 10 has a construction (not shown) such that a hot junction thereof is kept in contact with the back face of the electronic watch and a cold junction thereof is kept in contact with the face of the electronic watch so that a difference in temperature between both the junctions develops by a user carrying the electronic watch, thereby starting generation of electric energy. In this instance, the electric power generator 10 is assumed to develop an e.m.f. of at least 0.8 V when the electronic watch is being carried.

As shown in FIG. 2, the switching circuit 40 comprises a diode 41, charge switch 42, and discharge switch 43. The diode 41 as a switching element for preventing reverse flow of the electric energy generated to the electric power generator 10 is connected to the electric power generator 10 in series. That is, the anode of the diode 41 is connected to the positive source of the electric power generator 10, and the cathode thereof to the positive source of clock means 20.

For the charge switch 42 and discharge switch 43, a P-channel MOS field effect transistor (referred to hereinafter as FET) is used. Accordingly, the charge switch 42 and discharge switch 43 can be installed in an integrated circuit incorporating a clock circuit 21 of the clock means 20.

The drain of the charge switch 42 is connected to the positive source of the electric power generator 10, and the source of the discharge switch 43 is connected to the positive source of the clock means 20, respectively, while the source of the charge switch 42 and the drain of the discharge switch 43 are connected to the positive source of the electric power storage means 30. Further, the gate of the charge switch 42 and the discharge switch 43, respectively, is connected to the control means 50.

The clock means 20 comprises the clock circuit 21 for dividing the frequency of oscillating signals generated by a crystal oscillator used in common electronic watches and generating a driving waveform for a stepping motor, the stepping motor driven by the driving waveform generated by the clock circuit 21, gears, time display system 22 including the hands for displaying time, and a capacitor 23 functioning as a buffer for electric energy.

Inside the clock means 20, the capacitor 23, clock circuit 21, and time display system 22 are all connected in parallel.

In the clock circuit 21 of the clock means 20, the arithmetic means 80 incorporating a first voltage divider 60 and a second voltage divider 70 that are described hereinafter, and the controller 50, an integrated circuit composed of complementary MOS FETs (CMOS) (not shown) are used, respectively, as in common electronic watches and activated by the same power source.

The clock circuit 21 divides the frequency of the oscillating signal generated by the crystal oscillator at least until the signal has an oscillating period of 2 seconds or less (in the case of rotation of the hands at two-second intervals) and transforms the signal of divided frequency into a waveform necessary for driving the stepping motor incorporated in the time display system 22 to drive the same. The time display system 22 transmits rotation of the stepping motor while reducing a rotation velocity via the gears to drive the hands (second hand, minute hand, hour hand, and the like) for displaying time by rotation.

For the capacitor 23, an electrolytic capacitor or the like is used, and in this case, the same having capacitance of 10 $\mu$F is used.

The clock circuit 21 sends out a detection strobe S25 and a clock S26, that are internal signals of the clock circuit 21, to the controller 50. The clock S26 is rectangular wave having an oscillation period of, for example, one second, and delivered to the controller 50 for controlling ON/OFF of the switching circuit 40 as described later. The detection strobe S25 is an active HIGH signal for providing the first voltage divider 60, second voltage divider 70, and controller 50 with a timing for actuation, respectively.

Description of a waveform shaping circuit for the detection strobe S25 is omitted since the shaping of the waveform of the detection strobe S25 is well known however, the working of the detection strobe S25 will be described later.

The negative terminal of the clock means 20 is grounded, and a closed circuit is formed by the electric power generator 10, the diode 41, and the clock means 20.

For the electric power storage means 30, a lithium ion secondary battery is used, and the positive source of the electric power storage means 30 is connected to the source terminal of the charge switch 42 of the switching circuit 40 and to the drain terminal of the discharge switch 43 of the same. The negative terminal of the electric power storage means 30 is grounded.

The controller 50 and the clock means 20 are connected in parallel to the electric power generator 10 so as to be driven by electric energy generated by the electric power generator 10, or stored by the electric power storage means 30.

The controller 50 executes a switching operation of the switching circuit 40, that is, an operation to control ON/OFF of the switching circuit 40, sending out signals for electrically connecting or disconnecting between the electric power generator 10 and the electric power storage means 30. That is, the controller 50 outputs a charge signal S44 to the gate terminal of the charge switch 42, and a discharge signal S45 to the gate terminal of the discharge switch 43.

The arithmetic means 80, as shown in the circuit thereof in FIG. 3 by way of example, comprises the first voltage divider 60, second voltage divider 70, and a comparator 85 for comparing the magnitude of an output voltage of the first voltage divider 60 with that of the second voltage divider 70.

The first voltage divider 60 is a circuit for dividing a generated voltage of the electric power generator 10 and outputting a first divided voltage, receiving a voltage at the positive source of the electric power generator 10 as the generated voltage V61.

On the other hand, the second voltage divider 70 is a circuit for dividing a stored voltage of the electric power storage means 30 and outputting a second divided voltage, receiving a voltage at the positive source of the electric power storage means 30 as the stored voltage V71.

Further, the comparator 85 compares a first divided voltage output V62 of the first voltage divider 60 with a second divided voltage output V72 of the second voltage divider 70 to decide which is higher, and outputs at the HIGH level if the first divided voltage output V62 is higher than the second divided voltage output V72 (V62>V72) while otherwise outputting at the LOW level.

The first voltage divider 60, and second voltage divider 70 are provided to divide voltages delivered to the comparator 85 so as to enable the comparator 85 to compare indirectly the value of the generated voltage V61 with that of the stored voltage V71, finding a ratio of one to the other.

One of the reasons for this is that with a common amplifier circuit used for the comparator 85, an accurate comparison operation cannot be executed unless a voltage inputted to the amplifier circuit is equal to or less than a voltage at the power supply source of the amplifier circuit.

Now a specific example of the construction and operation of the arithmetic means 80 and controller 50 are described with reference to FIG. 3.

The first voltage divider 60 of the arithmetic means 80 comprises a dividing resistor 63 and a divider switch 64 while the second voltage divider 70 comprises a dividing resistor 73 and a divider switch 74.

The generated voltage V61 delivered from the electric power generator 10 is applied to one end of the dividing resistor 63 of the first voltage divider 60, composed of high precision resistance elements, and the other end of the dividing resistor 63 is grounded via the divider switch 64, that is, via the channel between the drain and source of an N-channel FET. The detection strobe S25 from the controller 50 is applied to the gate of the divider switch 64.

It is constructed such that the first divided voltage output V62 is outputted from an intermediate point of the dividing resistor 63. The first divided voltage output V62 is tapped from a point where a voltage equivalent to, in this example, one third of the generated voltage V61, appears when the divider switch 64 is turned ON, and electric current flows through the dividing resistor 63.

For example, in the case of the total ohmic value of the dividing resistor 63 being 600 kΩ, an ohmic value between the end of the dividing resistor 63 where the generated voltage V61 is applied and a terminal thereof, where the first divided voltage output V62 is tapped, is 400 kΩ.

On the other hand, the stored voltage V71 delivered from the electric power storage means 30 is applied to one end of the dividing resistor 73 of the second voltage divider 70, composed of high precision resistance elements, and the other end of the dividing resistor 73 is grounded via the divider switch 74, that is, via the channel between the drain and source of an N-channel FET. The detection strobe S25 from the controller 50 is applied to the gate of the divider switch 74.

It is constructed such that the second divided voltage output V72 is outputted from an intermediate point of the dividing resistor 73. The second divided voltage output V72 is tapped from a point where a voltage equivalent to, in this example, one third of the stored voltage V71, appears as in the case of the first divided voltage output V62, when the voltage divider switch 74 is turned ON, and electric current flows through the dividing resistor 73.

For example, in the case of the total resistance of the dividing resistor 73 being 600 kΩ, a resistance between the end of the dividing resistor 73 where the stored voltage V71 is applied and a terminal where the second divided voltage output V72 is tapped, is 400 kΩ.

Thus, in the first embodiment, a voltage division ratio of the first voltage divider 60 and that of the second voltage divider 70 is set on the basis of 1:1, equally at one third of respective input voltages, ensuring that a correlation in magnitude between the first divided voltage output V62 and the second divided voltage output V72 corresponds exactly to that between the generated voltage V61 and the stored voltage V71.

Accordingly, when the ratio of the first divided voltage output V62 to the second divided voltage output V72 is 1/1 or less, the comparator 85 switches the arithmetic output S81 to the LOW level, and when the ratio exceeds 1/1, to the HIGH level. The ratio of the generated voltage V61 to the stored voltage V71 can be calculated in this way.

The voltage division ratio of the first voltage divider 60 and that of the second voltage divider 70 may be changed to, for example, 1/3 and 2/3 (on the basis of 1:2), respectively, thereby enabling the comparator 85 to vary the level of the arithmetic output S81 in the case where the ratio of the generated voltage V61 to the stored voltage V71 is other than 1/1, for example, 1/2 or less, or in excess of that. That is, various ratios of the generated voltage V61 to the stored voltage V71 can be calculated.

As shown in FIG. 3, the controller 50 comprises a data latch 51, a gate 52 for charging signals, and a first inverter 53.

The data latch 51 is a data latch for holding data on falling edge of the waveform of the detection strobe S25, receiving the arithmetic output S81 from the comparator 85 of the arithmetic means 80 as input data, and outputs the data held as a discharge signal S45 to the switching circuit 40 shown in FIG. 2.

The gate 52 for charging signals is a triple input AND gate, sending out an AND of a NOT signal S25 of the detection strobe S25, the clock S26, and the discharge signal S45 outputted from the data latch 51, as a charge signal S44, to the switching circuit 40 in FIG. 2. The NOT signal S25 of the detection strobe S25 is obtained by inverting the detection strobe S25 through the first inverter 53.

Next, the operation of the electronic watch according to the first embodiment is described with reference to a waveform chart shown in FIG. 4.

To start with, description is made of the operation thereof when the electronic watch is actuated with the electric power generator 10 starting generation of electric power in the case where the electric power storage means 30 shown in FIG. 2 is in a substantially depleted state after the electronic watch has been left unused for a long time.

For brevity in description, both the charge switch 42 and the discharge switch 43 are assumed to be kept OFF during the initial stage of the operation of the switching circuit 40 in FIG. 2.

As soon as the electric power generator 10 starts generation of electric energy, the capacitor 23 is charged with generated electric energy via the diode 41, causing the clock means 20 to start clocking operation.

Similarly, the controller 50 and arithmetic means 80 are activated.

As the clock circuit 21 of the clock means 20 is executing an operation to cause oscillation and divide the oscillation frequency, the clock means 20 outputs signals at one-second intervals as the clock S26.

Meanwhile, the clock means 20 outputs the detection strobe S25 in a waveform having a period of 1 second and staying at the HIGH level for a duration of about 60 $\mu$s as shown in FIG. 4.

When the detection strobe S25 is generated and for the duration of the detection strobe S25 staying at the HIGH level, the divider switch 64 of the first voltage divider 60 and the divider switch 74 of the second voltage divider 70, as shown in FIG. 3, are turned ON, and the generated voltage V61 and the stored voltage V71 are divided at a predetermined voltage division ratio, and delivered to the comparator 85, respectively.

Particularly, in this instance, the voltage at the power supply source of the arithmetic means 80 is lower than the generated voltage V61 by the amount of voltage drop occurring at the diode 41. However, since the generated voltage V61 is divided by the first voltage divider 60 such that the input voltage delivered to the comparator 85 is lower than the voltage at the power supply source of the arithmetic means 80, proper comparison operation of the comparator 85 is ensured.

Further, as the NOT signal $\overline{S25}$ of the detection strobe S25 is delivered to the gate 52 for charging signals, the charge signal S44 is forced to be at the LOW level while the detection strobe S25 is at the HIGH level, thereby turning the charge switch 42 OFF. Consequently, the electric power generator 10 is cut off from the electric power storage means 30.

As a result, the first voltage divider 60 is able to properly divide the generated voltage V61 without being subjected to the effect of the stored voltage V71 as long as the detection strobe S25 is at the HIGH level. Similarly, the second voltage divider 70 is able to properly divide the stored voltage V71 without being subjected to the effect of the generated voltage V61.

In the case where the electric power storage means 30 is substantially depleted with the stored voltage V71 at about 0.8 V and the clock means 20 is operating satisfactorily, the generated voltage V61 of the electric power generator 10 is by far higher than the stored voltage V71.

If the ratio of the generated voltage V61 to the stored voltage V71 is thus greater than 1/1, an operation to divide voltage is executed by the first voltage divider 60 and the second voltage divider 70, respectively, at the timing of the detection strobe S25 switching to the HIGH level, thereby causing the comparative output (arithmetic output) S81 of the comparator 85 to turn to the HIGH level.

However, since the comparative output S81, when the detection strobe S25 is at the LOW level, will be unaffected in operational terms irrespective of signal levels, the same is shown by the broken line in FIG. 4 for brevity.

The data latch 51 shown in FIG. 3 holds the arithmetic output S81 already at the HIGH level at the moment of the detection strobe S25 starting to fall, causing the discharge signal S45 to switch to the HIGH level. While the discharge signal S45 is at the HIGH level, the discharge switch 43, which is a P-channel FET, remains OFF.

After the detection strobe S25 turns to the LOW level, the gate 52 for charging signals outputs the clock S26 as the charge signal S44.

Accordingly, the charge switch 42 is turned ON only as long as the clock S26 is at the HIGH level with the result that the electric power storage means 30 is charged with electric energy generated by the electric power generator 10 cyclically.

Consequently, while the electric power generator 10 is generating electric power at a voltage higher than the stored voltage of the electric power storage means 30, a part of the electric energy generated can be utilized for charging the electric power storage means 30 while the clock means 20 is in operation.

Next, description is made of the operation of the electronic watch when the electric power generator 10 stops generating electric energy after charging of the electric power storage means 30 is well under way.

When the electric power generator 10 stops generating electric energy, the first voltage divider 60 and the second voltage divider 70 are activated at the time the detection strobe S25 switches to the HIGH level as described in the foregoing, and the arithmetic output S81 switches to the LOW level as the ratio of the generated voltage V61 to the stored voltage V71 becomes less than 1/1.

Upon the data latch 51 holding the arithmetic output S81 at the LOW level, the discharge signal S45 switches to the LOW level, forcing the charge signal S44 to turn to the LOW level as well.

As a result, the charge switch 42 in FIG. 2 is switched OFF, and the discharge switch 43 is switched ON, discharging electric energy stored by the electric power storage means 30 to the clock means 20.

Thus, when the generated voltage of the electric power generator 10 is lower than the stored voltage of the electric power storage means 30, the charging operation is stopped immediately while the operation of the clock means 20 can be continued by utilizing electric energy stored by the electric power storage means 30.

With such an arrangement as described in the foregoing, at whatever level the terminal voltage of the electric power generator 10 and the electric power storage means 30, respectively, may be, it is possible to detect through the arithmetic means whether or not the electric power generator 10 is in a condition to be able to charge the electric power storage means 30 with generated electric energy, and further to control the switching circuit 40 such that the electric power storage means 30 is charged according to the arithmetic output. Therefore, this can prevent occurrence of the case where charging cannot be executed in spite of a charging potentiality (i.e. potential ability of the electric power storage means to be charged) as encountered in the case of conventional electronic watches, thus enabling the electric power storage means 30 to be charged with electric energy highly efficiently.

In the first embodiment described hereinbefore, a method of charging the electric power storage means 30 cyclically by use of the clock S26 simply on a one-to-one time sharing basis is adopted. However, charging may not be limited to such a method, and charging conditions or a method of controlling charging may be varied.

For example, a detector for detecting the terminal voltage of the clock means 20 may be installed so that a method of charging only when the terminal voltage of the clock means 20 is at a predetermined value or higher and the generated voltage V61 is higher than the stored voltage V71, or a method of varying the time sharing ratio of charging time according to the terminal voltage of the clock means 20 in addition to the aforesaid method may be adopted.

Further, in the first embodiment, the voltage division ratio of the first voltage divider 60 and that of the second voltage divider 70 are set to be equal at a ratio of 1:1. However, respective voltage division ratios may be varied as described in the foregoing. It is also possible to start charging operation, for example, only when the generated voltage V61 is higher than the stored voltage V71 by a factor of 1.2, or to enable charging operation only when the generated voltage V61 is not lower than the stored voltage V71 as detected by detection means installed for detecting the stored voltage V71 normally, but the generated voltage V61 is higher than the stored voltage V71 by a factor of 1.3 in the case that the electric power storage means 30 is at a predetermined voltage or higher.

In addition, in the first voltage divider 60 and second voltage divider 70 described in the foregoing, means for dividing voltage by use of resistors are used. However, other means may be used.

For example, a method may be adopted whereby two capacitors are connected in series such that a ratio of capacitance instead of resistance represents the voltage division ratio and a divided voltage is tapped at an intermediate point therebetween. Further, the divider switch or the like may be dispensed with provided that there is no constraint in respect to current consumed when dividing voltage.

Although not described in the aforesaid first embodiment, it is also possible to provide booster means for boosting the generated voltage by changing over the connection condition of the capacitors so that when the generated voltage 61 is lower to than the stored voltage V71, the electric power storage means 30 is charged by a boosting voltage after activating the booster means instead of immediately executing charging.

An electronic watch wherein charging is executed by the boosting voltage will be described in detail with reference to a second embodiment of the invention.

Second Embodiment: FIGS. 5 to 10

The second embodiment of an electronic watch according to the invention is described with reference to FIGS. 5 to 10.

Figure 5:
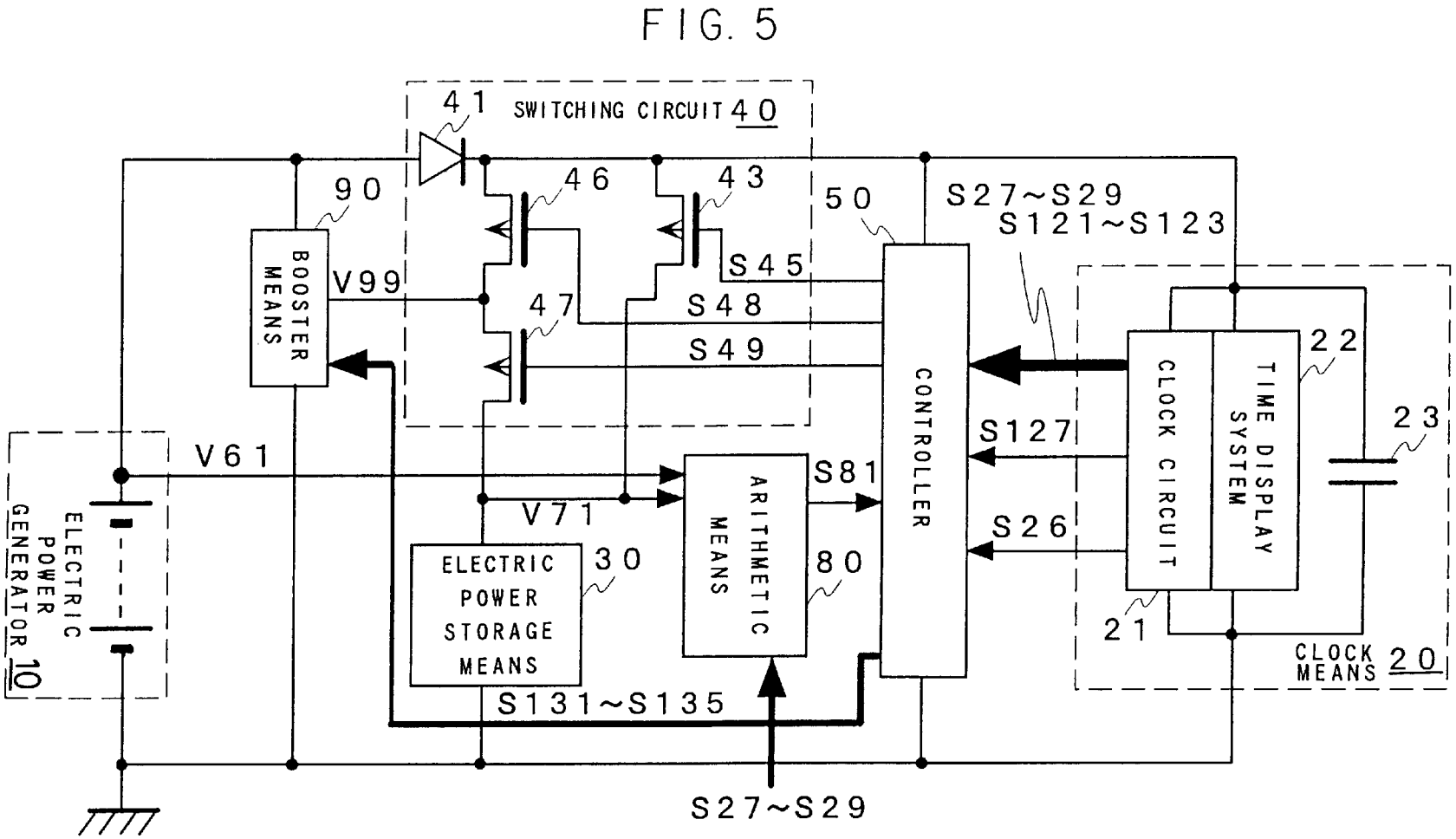
FIG. 5 is a block diagram showing the general construction of an electronic watch according to a second embodiment of the invention.

First, FIG. 5 shows the general arrangement thereof, and parts corresponding to those in FIG. 2 are denoted by the same reference numerals, and description thereof is omitted.

The second embodiment differs from the first embodiment in that booster means 90 is provided, and the construction and operation of clock means 20, switching circuit 40, arithmetic means 80, and controller 50 are somewhat different from the same for the first embodiment shown in FIG. 2.

As in the case of the first embodiment, the clock means 20 comprises a clock circuit 21 for dividing the frequency of oscillating signals generated by a crystal oscillator to generate a driving waveform for a stepping motor, a stepping motor driven by the driving waveform generated by the clock circuit 21, gears, and time display system 22 incorporating the hands for displaying time, plus a capacitor 23 functioning as a buffer for electric energy.

For the capacitor 23, an electrolytic capacitor or the like is used, and in this case, the same of capacitance at 22 $\mu$F is used.

The clock circuit 21 shapes a composite waveform from a onefold detection strobe S27, twofold detection strobe S28, threefold detection strobe S29, a clock S26, first boost clock S121, second boost clock S122, third boost clock S123, and boost enable clock S127, that are internal signals of the clock circuit 21, and delivers the composite waveform to the controller 50 and arithmetic means 80.

The clock S26 is rectangular wave having an oscillation period of, for example, 0.5 second, and is delivered to the controller 50 for controlling ON/OFF of the switching circuit 40 as described later.

The onefold detection strobe S27, twofold detection strobe S28, and threefold detection strobe S29 are active HIGH signals for providing the arithmetic means 80 and controller 50 with a timing for activation, respectively.

Description of waveform shaping circuits for the onefold detection strobe S27, twofold detection strobe S28, and threefold detection strobe S29, respectively, is omitted since the shaping of these waveforms is well known.

Figure 8:
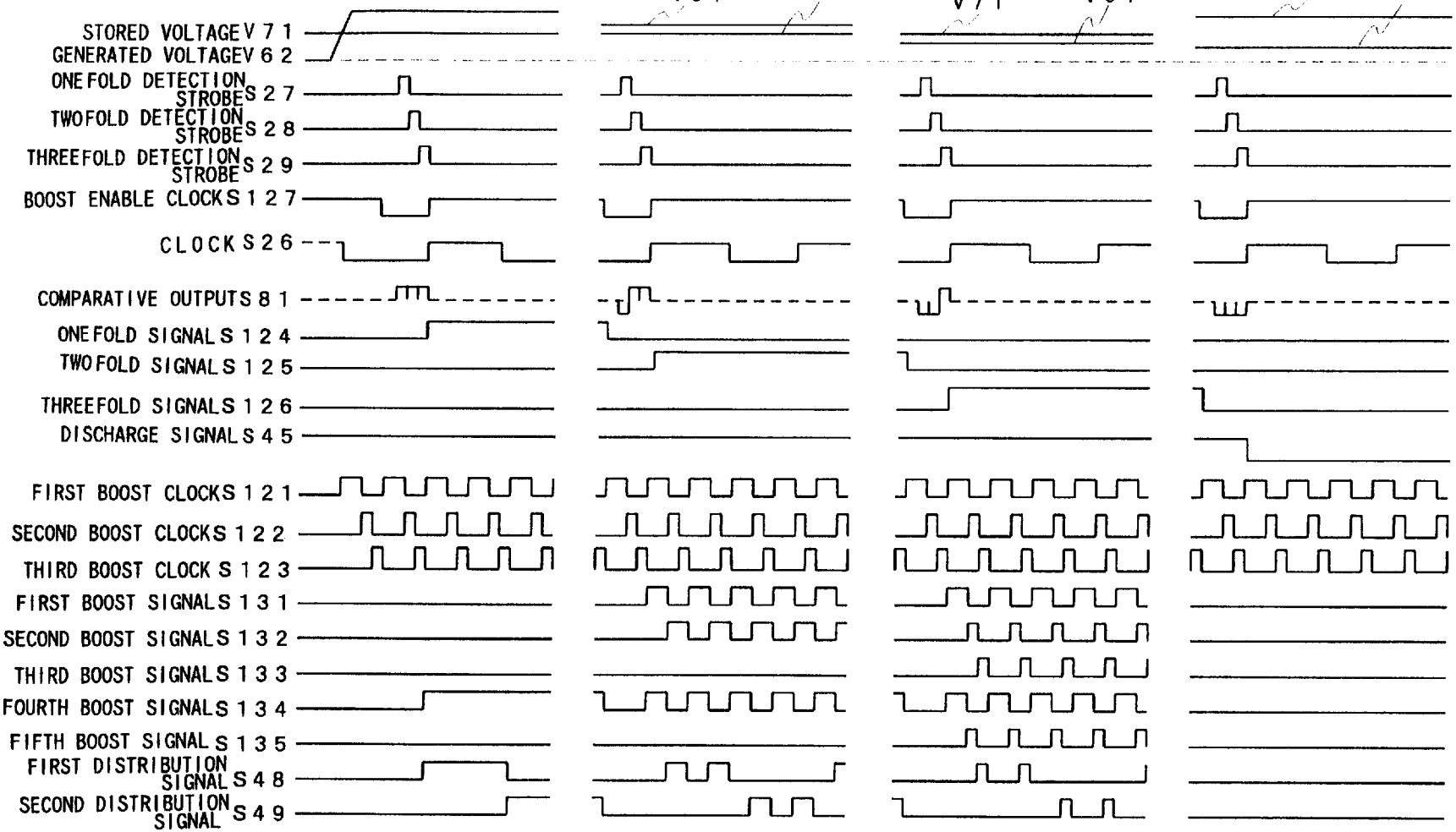
FIG. 8 is a waveform chart of signals from respective components of the electronic watch, shown in FIGS. 5 to 7.

All the detection strobes including the onefold detection strobe S27, twofold detection strobe S28, and threefold detection strobe S29 are in a waveform having the same frequency of 0.5 Hz and a HIGH level time of 244 $\mu$s. As shown in FIG. 8, the twofold detection strobe S28 is in a waveform rising at the fall time of the onefold detection strobe S27, and the threefold detection strobe S29 is in a waveform rising at the fall time of the twofold detection strobe S28.

Further, the first boost clock S121, second boost clock S122, third boost clock S123, and boost enable clock S127 are signals for obtaining a timing to actuate the booster means 90 as described later, and are delivered from the clock means 20 to the controller 50.

Description of waveform shaping circuits for these signals is omitted since the shaping of the waveforms thereof is well known.

As for waveforms of respective boost clocks, the first boost clock S121 is at a frequency of 1 KHz and has a HIGH level time of 488 μs while both the second boost clock S122 and the third boost clock S123 are at a frequency of 1 KHz and have a HIGH level time of 244 μs. As shown in FIG. 8, the second boost clock S122 is in a waveform rising at the fall time of the first boost clock S121, and the third boost clock S123 is in a waveform rising at the fall time of the second boost clock S122.

The boost enable clock S127 is in a waveform oscillating at a frequency of 0.5 Hz, having a LOW level time of 8 ms and rising simultaneously on falling edge of the threefold detection strobe S29 as shown in FIG. 8.

The negative terminal of the clock means 20 is grounded, and a closed circuit is formed by the electric power generator 10, diode 41, and clock means 20.

The booster means 90 is a circuit for boosting the generated voltage V61 of the electric power generator 10 twofold, threefold, or onefold (straight) by switching over the connection condition of the capacitors in order to deliver the boosting voltage output V99, and is connected to the electric power generator 10 in parallel. This is a charge pump circuit in common use, and will be described in detail later.

The switching circuit 40 comprises a diode 41, discharge switch 43, first distribution switch 46, and second distribution switch 47.

As in the case of the first embodiment, the diode 41 is connected to the electric power generator 10 in series to function as a switching element for preventing reverse flow of electric energy to the electric power generator 10.

For the discharge switch 43, first distribution switch 46, and second distribution switch 47, a P-channel MOS field effect transistor (referred to hereinafter as FET) is used, respectively.

These switching elements, each made up of a FET, can be installed in an integrated circuit incorporating the clock circuit 21 within the clock means 20.

The source terminals of the discharge switch 43 and first distribution switch 46, respectively, is connected to the positive terminal of the clock means 20.

For the electric power storage means 30, a lithium ion secondary battery is used, and the positive terminal of the electric power storage means 30 is connected to the drain terminal of the discharge switch 43 of the switching circuit 40. The negative terminal of the electric power storage means 30 is grounded.

The electric power storage means 30, even when depleted, is assumed to maintain a stored voltage of 0.8 V at the minimum.

The first distribution switch 46 and second distribution switch 47, have their drain terminals respectively connected to the terminal of boosting voltage output V99, and the source terminal of the first distribution switch 46 is connected to the positive terminal of the clock means 20 while the source terminal of the second distribution switch 47 is connected to the positive terminal of the electric power storage means 30.

The controller 50 and arithmetic means 80 described later are connected in parallel to the clock means 20 and electric power generator 10 so as to be driven by electric energy generated by the electric power generator 10, or electric energy stored by the electric power storage means 30.

The controller 50 sends out signals for electrically disconnecting or connecting among the electric power generator 10, the electric power storage means 30, and booster means 90 by controlling switching operation of the switching circuit 40. That is, the controller 50 sends out a discharge signal S45, first distribution signal S48, and second distribution signal S49 to the gate of the discharge switch 43, first distribution switch 46, and second distribution switch 47, respectively.

Furthermore, the controller 50 is set to control the booster means 90 by outputting boost signals, from a first boost signal S131 to fifth boost signal S135, via five signal lines to the booster means 90.

As in the first embodiment, the arithmetic means 80 is an arithmetic circuit for calculating and outputting the voltage ratio of a voltage generated by the electric power generator 10 to the terminal voltage of the electric power storage means 30 after receiving a generated voltage V61, which is a voltage at the positive terminal of the electric power generator 10, and a stored voltage V71, which is a voltage at the positive terminal of the electric power storage means 30. Then, the arithmetic means 80 outputs the results of calculation as an arithmetic output S81 to the controller 50.

Now, by way of example, the specific construction of the arithmetic means 80 and controller 50, shown in FIG. 5, will be described with reference to FIG. 6.

Figure 6:
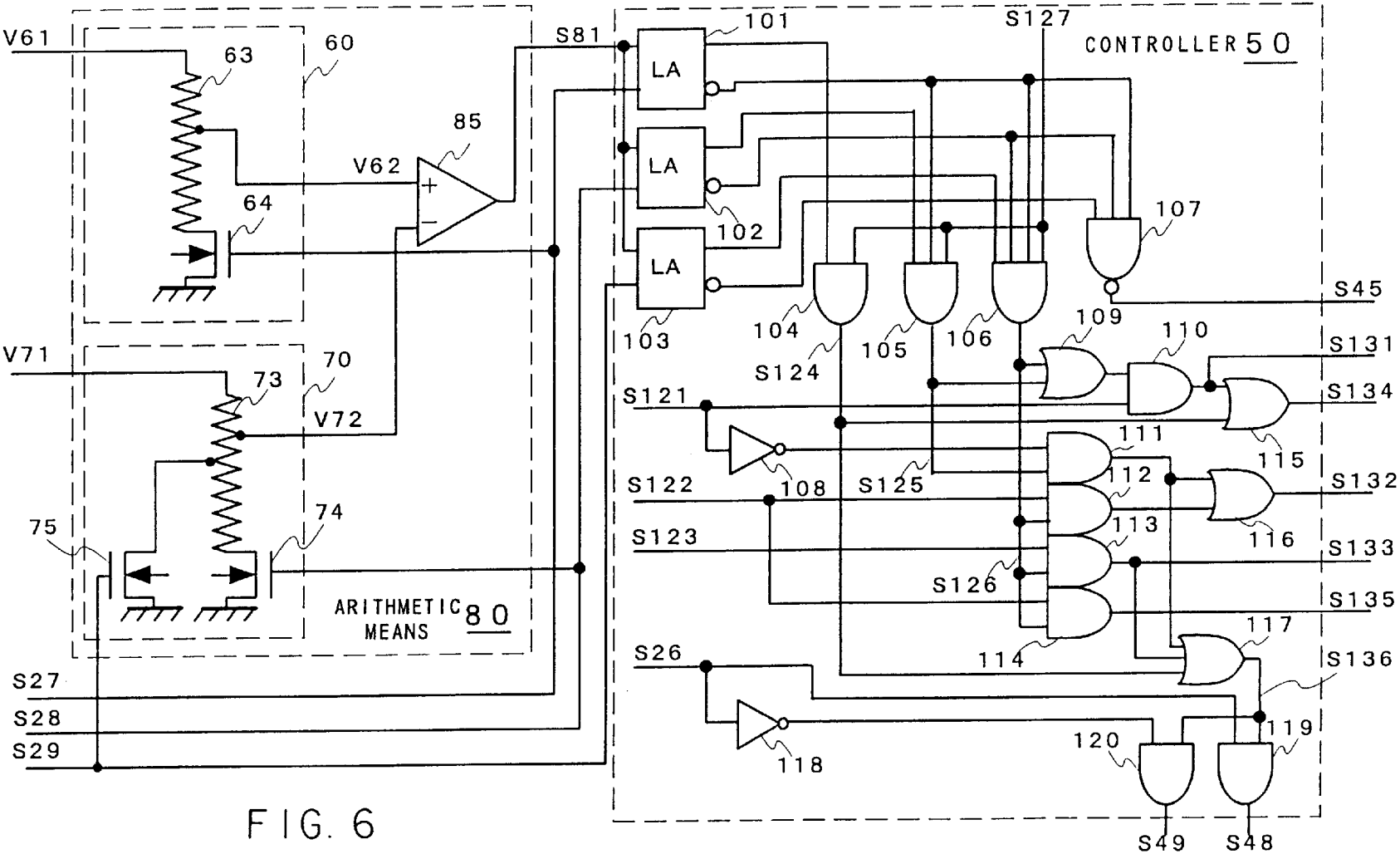
FIG. 6 is a circuit diagram showing an example of a specific circuit construction of arithmetic means and that of controller, shown in FIG. 5.

As with the case of the arithmetic means 80 shown in FIG. 3, the arithmetic means 80 according to the second embodiment shown in FIG. 6 also comprises a first voltage divider 60, a second voltage divider 70, and a comparator 85.

The first voltage divider 60 is a circuit for dividing the generated voltage V61 of the electric power generator 10 and outputting a first divided voltage, receiving the generated voltage V61, which is a voltage at the positive terminal of the electric power generator 10.

The second voltage divider 70 is a circuit for dividing the terminal voltage of the electric power storage means 30 and outputting a second divided voltage, receiving the stored voltage V71, which is a voltage at the positive terminal of the electric power storage means 30.

The comparator 85 is for comparing the first divided voltage V62 from the first voltage divider 60 with the second divided voltage V72 from the second voltage divider 70, and outputting a binary level signal according to the results of such comparison.

The first voltage divider 60, and second voltage divider 70 are provided to divide input voltages for the comparator 85 SO as to enable the comparator 85 to get the voltage ratio of the generated voltage V61 to the stored voltage V71. This is because as with the case of the first embodiment, in an amplifier circuit used in the comparator 85, an accurate comparative operation can not be executed unless the voltage inputted to the comparator is equal to or less than the voltage at the power supply source of the amplifier circuit and further, division to find the voltage ratio can be carried out easily in this way.

The first voltage divider 60 comprises a dividing resistor 63 and a divider switch 64 while the second voltage divider 70 comprises a dividing resistor 73 and divider switches 74 and 75.

The generated voltage V61 delivered from the electric power generator 10 is applied to one end of the dividing resistor 63 of the first voltage divider 60, composed of high precision resistance elements, and the other end of the dividing resistor 63 is grounded via the divider switch 64, that is, the channel between the drain and source of an N-channel FET. The onefold detection strobe S27 outputted from the clock circuit 21 shown in FIG. 5 is applied to the gate of the divider switch 64. The first voltage divider 60 is constructed such that a first divided voltage output V62 is outputted from an intermediate point of the dividing resistor 63.

The first divided voltage output V62 is tapped from a point where a voltage equivalent to two thirds of the generated voltage V61 appears as a result of electric current flowing through the dividing resistor 63 when the divider switch 64 is ON.

For example, in the case of the total ohmic value of the dividing resistor 63 being 600 kΩ, the ohmic value between the end of the dividing resistor 63 where the generated voltage V61 is applied and a point where the first divided voltage output V62 is tapped is 200 kΩ.

On the other hand, the stored voltage V71 delivered from the electric power storage means 30 is applied to one end of the dividing resistor 73 of the second voltage divider 70, composed of high precision resistance elements, and the other end of the dividing resistor 73 is grounded via the divider switch 74, that is, the channel between the drain and source of the N-channel FET. The twofold detection strobe S28 outputted from the clock circuit 21 shown in FIG. 5 is applied to the gate of the divider switch 74.

The second voltage divider 70 is constructed such that the second divided voltage output V72 is delivered from an intermediate point of the dividing resistor 73.

The second divided voltage output V72 is tapped from a point where a voltage equivalent to five sixths of the stored voltage V71 appears as a result of electric current flowing through the dividing resistor 73 when the voltage divider switch 74 is ON.

For example, in the case of the total resistance of the dividing resistor 73 being 600 kΩ, the resistance between the end of the dividing resistor 73 where the stored voltage V71 is applied and a point where the second divided voltage output V72 is tapped is 100 KΩ.

Further, another intermediate point of the dividing resistor 73 is grounded via the channel between the drain and source of the divider switch 75. Accordingly, the second divided voltage output V72 equivalent to one third of the stored voltage V71 as a result of electric current flowing through the dividing resistor 73 via the divider switch 75 when the divider switch 75 is ON and the divider switch 74 is OFF.

For example, if the ohmic value between the end of the dividing resistor 73 where the stored voltage V71 is applied and a point where the second divided voltage output V72 is tapped is 100 kΩ, the ohmic value between the point where the second divided voltage output V72 is tapped and the drain of the divider switch 75 is set at 50 KΩ.

With the first voltage divider 60, when the divider switch 64 is OFF, division of voltage is not executed, and the generated voltage V61 is delivered immediately as the first divided voltage output V62.

The same can be said of the second voltage divider 70 when both the divider switches 74 and 75 are OFF.

Therefore, when any one among the divider switch 64 of the first voltage divider 60, and the divider switches 74, 75 of the second voltage divider 70 is exclusively turned ON, the voltage division ratio of the first divided voltage output V62 to the generated voltage V61 versus the same of the second divided voltage output V72 to the stored voltage, that is, (the first divided voltage output V62/the generated voltage V61):(the second divided voltage output V72/the stored voltage), becomes 2:3 when only the divider switch 64 is ON, 6:5 when only the divider switch 74 is ON, and 3:1 when only the divider switch 75 is ON.

Accordingly, the arithmetic output S81 of the comparator 80 switches to the HIGH level if the value of the generated voltage V61/the stored voltage is not less than 3/2 when only the divider switch 64 is ON, not less than 5/6 when only the divider switch 74 is ON, or not less than 1/3 when only the divider switch 75 is ON. Correlation among these ratios will be described in detail later.

As shown in FIG. 6, the controller 50 comprises first to third latches 101, 102, 103, first to tenth AND gates 104 to 106, 110 to 114, 119, 120, a NAND gate 107, first and second inverters 108, 118, and first to fourth OR gates 109, and 115 to 117.

Respective logic gates without input/output systems specified denote those of dual input and single output except the latches and inverters.

The arithmetic output S81 is delivered as input data to all of the first, second, and third latches 101, 102, and 103, which also receive the onefold, twofold, and threefold detection strobes S27, S28, and S29, respectively, so that the input data are incorporated and held by the respective latches on the falling edges of respective detection strobe waveforms.

The first AND gate 104 delivers an AND of the boost enable clock S127 and an output of the first latch 101 as a onefold signal S124.

In the second embodiment of the invention, the time when the boost enable clock S127 switches to the LOW level corresponds to a boost inhibit time, which is set for a duration of 8 ms.

The boost inhibit time is set with the aim of halting the operation of the booster means 90 during and immediately prior to the arithmetic means 80 calculating the generated voltage V61 so as not to cause erroneous detection by the same because there is a risk of a voltage at the terminal of the electric power generator 10 indicating a lower value than the actual generated voltage due to a load caused by operation of the booster means 90.

The generated voltage can be detected accurately by detecting the terminal voltage while halting the operation of the booster means 90 in this way.

The length of the boost inhibit time is determined as appropriate according to the time constant dependent on the internal impedance of the electric power generator and the capacitance of the booster means 90.

Further, the second AND gate 105, which is a triple input AND gate, outputs an AND of the boost enable clock S127, inverting output of the first latch 101, and output of the second latch 102 as a twofold signal S125.

The third AND gate 106, which is a quadruple input AND gate, outputs an AND of the boost enable clock S127, inverting output of the first latch 101, an inverting output of the second latch 102, and an output of the third latch 103 as a threefold signal S126.

The NAND gate 107, which is a triple input NAND gate, outputs a NOT signal of an AND of the inverting output of the first latch 101, the inverting output of the second latch 102, and the inverting output of the third latch 103 as the discharge signal S45.

With the arrangement described above, the first AND gate 104, second AND gate 105, third AND gate 106, and NAND gate 107 make up a decoder for decoding easily the outputs of the first latch 101, second latch 102, and third latch 103. In the second embodiment, the decoder turns active by selecting only one signal among the onefold signal S124, twofold signal S125, threefold signal S126, and discharge signal S45 except in the case where the boost enable clock S127 is at the LOW level, provided that the discharge signal S45 is an active LOW signal.

For example, in case of the onefold signal S124 going HIGH, the output of at least the first latch 101 is at the HIGH level, and consequently, one of the inputs to the second AND gate 105, third AND gate 106, and NAND gate 107, respectively, switches to the LOW level, causing the twofold signal S125 and threefold signal S126 to turn to the LOW level, with the result that the discharge signal S45 to go HIGH.

The first OR gate 109 outputs an OR of the twofold signal S125 and threefold signal S126, and the fourth AND gate 110 outputs an AND of the OR and the first boost clock S121 as the first boost signal S131.

The second OR gate 115 outputs an OR of the first boost signal S131 and the onefold signal S124 as the fourth boost signal S134.

The fifth AND gate 111 generates an AND of an inverting signal of the first boost clock S121, and the twofold signal S125. The sixth AND gate 112 generates an AND of the second boost clock S122 and the threefold signal S126, and then, the third OR gate 116 outputs an OR of the aforesaid two outputs as the second boost signal S132. The inverting signal of the first boost clock S121 is obtained by inverting the first boost clock S121 through the first inverter 108.

The seventh AND gate 113 outputs an AND of the third boost clock S123 and the threefold signal S126 as the third boost signal S133. The eighth AND gate 114 outputs an AND of the second boost clock S122 and the threefold signal S126 as the fifth boost signal S135.

Furthermore, the fourth OR gate 117, which is a triple input OR gate, outputs an OR of the output of the fifth AND gate 111, the third boost signal S133, and the onefold signal S124 as the sixth boost signal S136.

With the arrangement described above, when only the onefold signal S124 among the onefold signal S124, twofold signal S125, and threefold signal S126 is at the HIGH level, the fourth boost signal S134 and the sixth boost signal S136, among the boost signals, go HIGH.

When only the twofold signal S125 is at the HIGH level, the first boost clock S121 is outputted as the first boost signal S131 and the fourth boost signal S134, and the inverting signal of the first boost clock S121 is outputted as the second boost signal S132 and the sixth boost signal S136.

Further, when only the threefold signal S126 is at the HIGH level, the first boost clock S121 is outputted as the first boost signal S131 and the fourth boost signal S134, the second boost clock S122 is outputted as the second boost signal S132 and the fifth boost signal S135, and the third boost clock S123 is outputted as the third boost signal S133 and the sixth boost signal S136.

On the other hand, the ninth AND gate 119 outputs an AND of the sixth boost signal S136 and the clock S26 as the first distribution signal S48, and the tenth AND gate 120 outputs an AND of the sixth boost signal S136 and an inverting signal of the clock S26 as the second distribution signal S49. The inverting signal of the clock S26 is obtained by inverting the clock S26 through the second inverter 118.

Such an arrangement as described above is capable of outputting the sixth boost signal S136 as the first distribution signal S48 and second distribution signal S49, alternately, according to the clock S26.

That is, for a duration of the clock S26 being at the HIGH level, the sixth boost signal S136 is outputted as the first distribution signal S48, and for a duration of the clock S26 being at the LOW level, the sixth boost signal S136 is outputted as the second distribution signal S49.

Now, by way of example, the specific construction of the booster 90 shown in FIG. 5 is described hereinafter with reference to FIG. 7.

Figure 7:
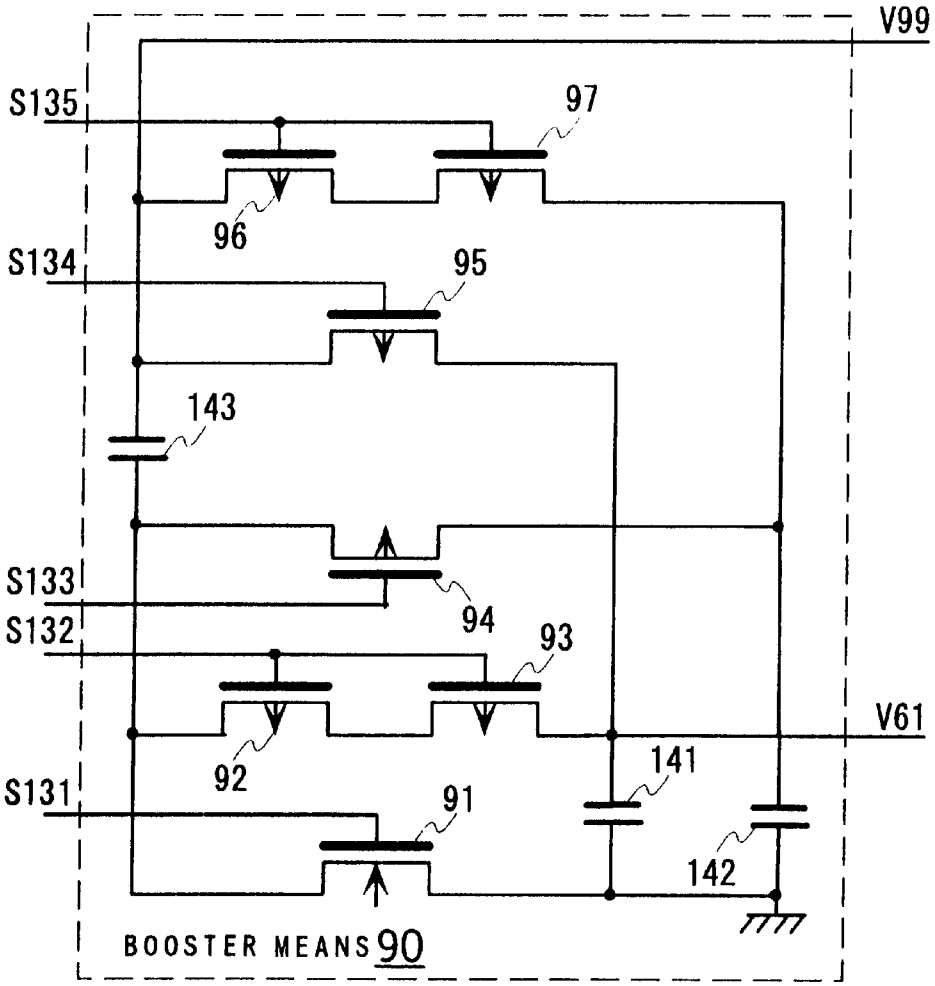
FIG. 7 is a circuit diagram showing an example of a specific circuit construction of booster means shown in FIG. 5.

As shown in FIG. 7, the booster 90 comprises first to seventh booster switches, 91 to 97, and first to third boosting capacitors, 141 to 143.

All of the first boosting capacitor 141 to third boosting capacitor 143 are mounted on the periphery of an integrated circuit incorporating the clock circuit 21 shown in FIG. 5, and for brevity in description, the respective boosting capacitors are assumed to have a capacitance of 0.22 $\mu$F.

The first booster switch 91 is an N-channel MOSFET, and the second to seventh booster switches, 92 to 97, are all P-channel MOSFETs. The first boosting capacitor 141 has the positive terminal connected to the positive voltage terminal of the electric power generator 10, and the negative terminal grounded.

The fifth booster switch 95 has the drain connected to the positive terminal of the first boosting capacitor 141, and the source connected to the positive terminal of the third boosting capacitor 143. The third boosting capacitor 143 has the negative terminal connected to the drain of the first booster switch 91, and the first booster switch 91 has the source grounded.

The second booster switch 92 and third booster switch 93 have respective sources connected to each other, the third booster switch 93 has the drain connected to the positive terminal of the first boosting capacitor 141, and the second booster switch 92 has the drain connected to the negative terminal of the third boosting capacitor 143.

The second boosting capacitor 142 has the negative terminal grounded, and the positive terminal connected to the source of the fourth booster switch 94 and the fourth booster switch 94 has the drain connected to the negative terminal of the third boosting capacitor 143.

Further, the sixth booster switch 96 and seventh booster switch 97 have respective sources connected to each other, the seventh booster switch 97 has the drain connected to the positive terminal of the second boosting capacitor 142, and the sixth booster switch 96 has the drain connected to the positive terminal of the third boosting capacitor 143.

The first boost signal S131 is impressed on the gate of the first booster switch 91, the second boost signal S132 on the gate of the second and third booster switches 92, 93, respectively, the third boost signal S133 on the gate of the fourth booster switch 94, the fourth boost signal S134 on the gate of the fifth booster switch 95, and the fifth boost signal S135 on the gate of the sixth and seventh booster switches 96, 97, respectively.

Next, the operation of the booster means 90 is described hereinafter.

In the second embodiment, the first to seventh booster switches, 91 to 97, are controlled by appropriate control signals delivered from the controller 50. However, in this instance, operation in various states of the booster switches only will be described without referring to the control signals.

First, when boosting a voltage twofold, the fourth booster switch 94, the sixth booster switch 96, and the seventh booster switch 97 are always turned OFF.

With these switches kept in this condition, and by turning the first booster switch 91 and the fifth booster switch 95 ON simultaneously, the first boosting capacitor 141 and the third boosting capacitor 143 are connected in parallel, and electric energy generated is stored in the third boosting capacitor 143, rendering a potential difference between the positive and negative terminals of the third boosting capacitor 143 substantially equal to the generated voltage V61.

Immediately thereafter, by turning the first booster switch 91 and the fifth booster switch 95 OFF, and simultaneously by turning the second booster switch 92 and the third booster switch 93 ON, the first boosting capacitor 141 and the third boosting capacitor 143 are connected in series, and a voltage twice as high as the generated voltage V61 can be obtained as a boosted voltage output V99.

Then, when boosting a voltage threefold, the fifth booster switch 95 and the first booster switch 91 are first turned ON, and the second, third, fourth, sixth, and seventh booster switches, designated 92, 93, 94, 96, and 97, respectively, are turned OFF so that electric energy generated is stored in the third boosting capacitor 143, rendering a voltage at the positive terminal of the third boosting capacitor 143 substantially equal to the generated voltage V61.

Immediately thereafter, by turning the sixth, seventh, second, and third booster switches, 96, 97, 92, and 93, respectively, ON and turning the fourth, fifth, and first booster switches, 94, 95, and 91, respectively, OFF, electric energy stored in the third boosting capacitor 143 and the first boosting capacitor 141 is delivered to the second boosting capacitor 142, raising a voltage at the positive terminal of the second boosting capacitor 142 twice as high as the generated voltage V61.

Subsequently, by turning the fourth booster switch 94 ON, and turning the first, second, third, fifth, sixth, and seventh booster switches, 91, 92, 93, 95, 96, and 97, respectively, OFF, a voltage three times as high as the generated voltage V61 can be obtained as a boosted voltage output V99.

Then, when boosting a voltage onefold, that is, charging the electric power storage means 30 by applying the generated voltage straight thereto, the generated voltage as it is can be delivered as a boosted voltage output V99 by keeping the fifth booster switch 95 ON all the time.

Since the operation of the booster means 90 is controlled by the first to fifth boost signals, S131 to S135, outputted by the controller 50 as previously described in detail with reference to FIG. 6, ON/OFF conditions of the first to seventh booster switches can be changed over thereby, enabling the boosting operation as described to be executed selectively.

Now, the operation of the electronic watch according to the second embodiment of the invention is described with reference to FIGS. 5 to 10.

The operation thereof is first described with reference to a case where the electronic watch is actuated with the electric power generator 10 starting generation of electric energy from a state where the electric power storage means 30 is in a substantially depleted state after the electronic watch has been left unused for a long time.

For brevity in description, the discharge switch 43, the first distribution switch 46, and the second distribution switch 47 are all assumed to be in the OFF condition in the initial stage of the operation of the switching circuit 40.

Upon the electric power generator 10 in FIG. 5 starting generation of electric energy, the capacitor 23 is charged with the generated electric energy via the diode 41, and the clock means 20 starts clocking operation. Similarly, the controller 50 and arithmetic means 80 are actuated as well.

As the clock circuit 21 of the clock means 20 are executing an operation to divide the frequency of oscillation signals generated by a crystal oscillator, the clock means 20 outputs signals at 0.5-second intervals as the clock S26.

Now, the operation of the arithmetic means 80 and controller 50 are described.

As shown in FIG. 8, the clock means 20 outputs the boost enable clock S127 turning from a normally HIGH level to a LOW level state, and meanwhile, generates the onefold, twofold, and threefold detection strobes, designated S27, S28, and S29. respectively, in waveforms turning to a HIGH level sequentially.

Upon the generation of the onefold detection strobe S27 and for a duration of the onefold detection strobe S27 staying at the HIGH level, the divider switch 64 shown in FIG. 6 is turned ON, and a voltage obtained by dividing the generated voltage V61 at a predetermined ratio and the stored voltage V71 are inputted to the comparator 85.

Similarly, upon the generation of the twofold detection strobe S28, the divider switch 74 is turned ON, and the generated voltage V61 and a voltage obtained by dividing the stored voltage V71 at a predetermined ratio are inputted to the comparator 85.

Further, upon the generation of the threefold detection strobe S29, the voltage divider switch 74 is turned ON, and the generated voltage V61 and a voltage obtained by dividing the stored voltage V71 at another predetermined ratio are inputted to the comparator 85.

While the respective detection strobes are staying at the HIGH level, the comparator 85 compares magnitude of the respective divided voltages inputted, outputting the arithmetic output S81. That is, if the first divided voltage output V62 is higher than the second divided voltage output V72, the arithmetic output S81 goes HIGH, and otherwise, stays at the LOW level. The arithmetic output S81 varies according to the ratio of the generated voltage V61 to the stored voltage V71.

Meanwhile, a series of operations are performed by the arithmetic means 80 and controller 50 whereby the first latch 101 to the third latch 103 incorporate values of the arithmetic output S81, respectively, at the time that the respective detection strobes fall, thereby completing an operation to detect arithmetic results.

Particularly, in this instance, the voltage at the power supply source of the comparator 85 is lower than the generated voltage V61 by an amount of voltage drop occurring at the diode 41. However, since input voltages delivered to the comparator 85 are low in comparison with the voltage at the power supply source thereof, proper comparison operation by the comparator 85 is ensured.

Further, as the boost enable clock S127 is at the LOW level during these operations described above, the signals from the onefold signal S124 to the threefold signal 126 are all at the LOW level with the result that all the outputs of the fourth AND gate 110 to the eighth AND gate 114 are at the LOW level.

That is, the first to fifth boost signals, S131 to S135, are all at the LOW level, and the boosting operation is stopped.

Furthermore, as the discharge signal S45 is at the HIGH level, and the first and second distribution signals, S48 and S49, are at the LOW level, the switching circuit 40 is able to cut off the electric power generator 10 from the electric power storage means 30 and booster means 90 so that a ratio of the terminal voltage of the electric power generator 10 to that of the electric power storage means 30 can be calculated accurately by the arithmetic means 80.

When the electric power storage means 30 is in a substantially depleted state with the stored voltage thereof at 0.8 V, and the clock means 20 is in a satisfactory operation, the generated voltage V61 of the electric power generator 10 is by far higher than the stored voltage V71.

In this case, if the generated voltage V61 is equivalent to 3/2 of the stored voltage V71 or higher, that is, the generated voltage V61 is 1.2 V or higher when the stored voltage V71 is 0.8 V, the voltage dividing operation is executed by the first voltage divider 60 at the timing of the onefold detection strobe S27 going HIGH with the result that the arithmetic output S81 of the comparator 85 turns to the HIGH level, and latched by the first latch 101, which in turn outputs a signal at the HIGH level.

However, with the respective detection strobes at the LOW level, the arithmetic output S81 will be unaffected in operational terms irrespective of signal levels, and accordingly, is shown by the broken line in FIG. 8 for brevity.

When the first latch 101 is outputting at the HIGH level, as soon as the boost enable clock 127 rises from the LOW to HIGH level, the onefold signal 124 goes HIGH with both the twofold signal S125 and the threefold signal S126 staying LOW.

Then, as is evident from the circuit diagrams shown in FIGS. 6 and 7, and the construction of the electronic watch described previously, the onefold signal 124 is inputted to the second OR gate 115 and fourth OR gate 117, keeping the fourth boost signal S134 and the sixth boost signal S136 at the HIGH level all the time, and the fifth booster switch 95 ON all the time, and the first distribution switch 46 and the second distribution switch 47 are turned ON and OFF, alternately and continuously, at intervals of 0.25 second.

This enables the booster means 90 to deliver electric energy generated by the electric power generator 10 to the clock means 20 and the electric power storage means 30 so as to be able to charge the electric power storage means 30 with the electric energy while driving the clock means 20.

When the output of the first latch 101 is at the HIGH level, one of the inputs to the NAND gate 107 switches to the LOW level, causing the discharge signal S45 to go HIGH, and keeping the discharge switch 43 OFF.

Next, an operation when the generated voltage has somewhat declined with the elapse of time is described hereinafter. For the sake of brevity, an assumption is made that much progress has not been made in the charging of the electric power storage means 30, and the stored voltage V71 remains at 0.8 V.

In this instance, if the generated voltage V61 is equivalent to 5/6 of the stored voltage V71 or higher but lower than 3/2 thereof, for example, if the generated voltage V61 is in the range of 1.2 V~0.67 V when the stored voltage V71 is 0.8 V, the voltage dividing operation executed by the first voltage divider 60 at the timing of the onefold detection strobe S27 going HIGH will turn the arithmetic output S81 of the comparator 85 to the LOW level, and the arithmetic output S81 is latched by the first latch 101, and outputted therefrom at a LOW level.

Immediately thereafter, the voltage dividing operation executed by the second voltage divider 70 at the timing of the twofold detection strobe S28 going HIGH will turn the arithmetic output S81 of the comparator 85 to the HIGH level, and the computation output S81 is latched by the second latch 102, and outputted therefrom at the HIGH level.

When the first latch 101 outputs at the LOW level and the second latch 102 outputs at the HIGH level, the twofold signal 125 goes HIGH as soon as the boost enable clock S127 rises from the LOW to HIGH level, leaving both the onefold signal S124 and the threefold signal S126 at a LOW level.

At this point in time, the first booster switch 91 and the fifth booster switch 95 are turned ON while the first boost clock S121 goes HIGH, the second booster switch 92 and the third booster switch 93 are turned ON while an inverting signal of the first boost clock S121 goes HIGH, and the first distribution switch 46 and the second distribution switch 47 are turned ON/OFF alternately at intervals of 0.25 second, at the timing of the inverting signal of the first boost clock S121 going HIGH.

As a result, the booster means 90 is able to boost the voltage of electric energy generated by the electric power generator 10 twofold for delivery to the clock means 20 and the electric power storage means 30 so as to charge the electric power storage means 30 with electric energy while driving the clock means 20.

If the output of the second latch 102 is at the HIGH level, one of the inputs to the NAND gate 107 turns to the LOW level, rendering the discharge signal S45 to go HIGH, and the discharge switch 43 to remain OFF.

Next, an operation when the generated voltage has declined with the elapse of further time is described hereinafter.

For brevity in description, it is assumed in this case that much progress has not been made in the charging of the electric power storage means 30, and the stored voltage V71 remains at 0.8 V.

In this instance, if the generated voltage V61 is equivalent to 1/3 of the stored voltage V71 or higher but lower than 5/6 thereof, for example, if the generated voltage V61 is in the range of 0.67 V~0.27 V when the stored voltage V71 is 0.8 V, the voltage dividing operation executed by the first voltage divider 60 at the timing of the onefold detection strobe S27 going HIGH will switch the arithmetic output S81 of the comparator 85 to the LOW level, and the arithmetic output S81 is latched by the first latch 101, and outputted therefrom at the LOW level.

Immediately thereafter, the voltage dividing operation executed by the second voltage divider 70 at the timing of the twofold detection strobe S28 going HIGH will switch the arithmetic output S81 of the comparator 85 to the LOW level, and the arithmetic output S81 is latched by the second latch 102, and outputted therefrom at the LOW level.

Further immediately thereafter, the voltage dividing operation executed by the second voltage divider 70 at the timing of the threefold detection strobe S29 going HIGH will switch the arithmetic output S81 of the comparator 85 to the HIGH level, and the arithmetic output S81 is latched by the third latch 103, and outputted therefrom at the HIGH level.

When the first latch 101 and second latch 102 output at the LOW level and the third latch 103 outputs at the HIGH level, the threefold signal 126 goes HIGH as soon as the boost enable clock S127 rises from the LOW to HIGH level, leaving both the onefold signal S124 and the twofold signal S125 at the LOW level.

At this point in time, the first booster switch 91 and the fifth booster switch 95 are turned ON while the first boost clock S121 goes HIGH, and the second booster switch 92, third booster switch 93, sixth booster switch 96, and seventh booster switch 97 are turned ON while the second boost clock S122 goes HIGH. Further, the fourth booster switch 94 is turned ON while the third boost clock S122 goes HIGH, and the first distribution switch 46 and the second distribution switch 47 are turned ON/OFF alternately at intervals of 0.25 second at the timing of the third boost clock S123 going HIGH.

As a result, the booster means 90 is able to boost the voltage of electric energy generated by the electric power generator 10 threefold for delivery to the clock means 20 and the electric power storage means 30 so as to charge the electric power storage means 30 with the electric energy while driving the clock means 20.

If the output of the third latch 103 is at the HIGH level, one of the inputs to the NAND gate 107 turns to the LOW level, rendering the discharge signal S45 to go HIGH, and the discharge switch 43 to remain OFF.

Next, description is made hereinafter of an operation when electric energy generated by the electric power generator 10 has declined to a minimal level, or the electric power generator 10 has stopped generation of the electric energy after progress has been made in the charging of the electric power storage means 30.

For brevity in description, it is assumed in this case that much progress has been made in the charging of the electric power storage means 30, and the stored voltage V71 has risen to 1.0 V.

In this instance, if the generated voltage V61 is less than 1/3 of the stored voltage V71, for example, if the generated voltage V61 is 0.33 V or lower when the stored voltage V71 is 1.0 V, the voltage dividing operation executed by the first voltage divider 60 at the time that the onefold detection strobe S27 goes HIGH will switch the arithmetic output S81 of the comparator 85 to the LOW level, and the arithmetic output S81 is latched by the first latch 101, and outputted therefrom at the LOW.

Immediately thereafter, the voltage dividing operation executed by the second voltage divider 70 at the time that the twofold detection strobe S28 goes HIGH will switch the arithmetic output S81 of the comparator 85 to the LOW level, and the arithmetic output S81 is latched by the second latch 102, and outputted therefrom at the LOW.

Further immediately thereafter, the voltage dividing operation executed by the second voltage divider 70 at the time that the threefold detection strobe S29 goes HIGH will switch the arithmetic output S81 of the comparator 85 to the LOW level, and the arithmetic output S81 is latched by the third latch 103, and outputted therefrom at the LOW.

When the first latch 101, second latch 102, and third latch 103 are all outputting at the LOW level, the onefold signal 124, twofold signal 125, and threefold signal 126 all switch to the LOW level as soon as the boost enable clock S127 rises from the LOW to HIGH level.

At this point in time, all the inputs to the NAND 107 go HIGH, rendering the discharge signal S45 to be at the LOW level, and turning the discharge switch 43 shown in FIG. 5 ON.

This permits the electric energy stored by the electric power storage means 30 to be delivered to the clock means 20 via the discharge switch 43 so that the clock means 20 can be driven continuously by the electric energy from the electric power storage means 30 even when the electric power generator 10 generates little electric energy.

At this point in time, all the booster switches from the first booster switch 91 to the seventh booster switch 97 are always turned OFF, and the first distribution switch 46 and the second distribution switch 47 are turned OFF as well with the result that the booster means 90 stops immediate operations to boost the voltage generated and to charge the electric power storage means 30.

Figure 9:
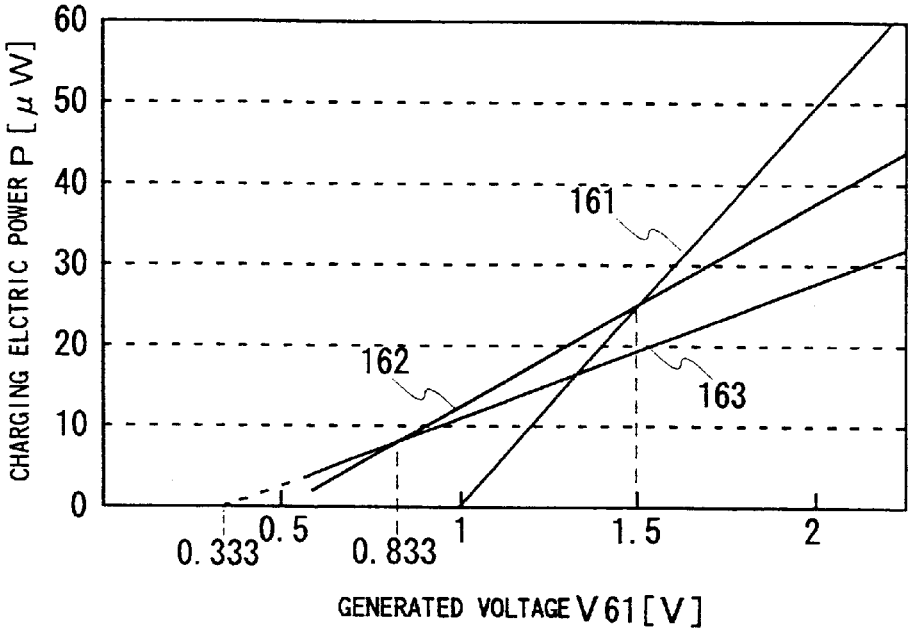
FIGS. 9 and 10 are graphs showing a correlation between a voltage generated and charging electric power supplied to electric power storage means in the second embodiment of the electronic watch according to the invention.
Figure 10:
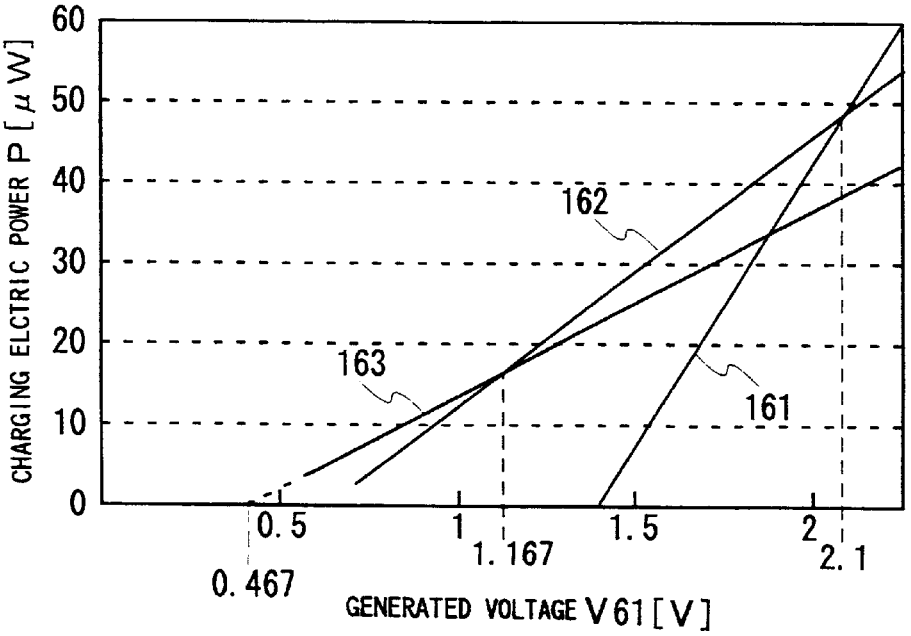

Now, FIGS. 9 and 10 show the charging characteristic of the booster means 90 by itself.

FIGS. 9 and 10 show a relationship between the generated voltage V61 of the electric power generator 10 and charging electric power P supplied to the electric power storage means 30 when, by way of example, the stored voltage V71 is 1.0 V, and 1.4 V, respectively. In this case, internal resistance of the electric power generator 10 is assumed to be 10 KΩ.

In FIGS. 9 and 10, the line designated 161 denotes the characteristic of charging the electric power storage means 30 at a onefold boosted voltage, that is, the onefold boosting characteristic, line 162 the twofold boosting characteristic, and line 163 the threefold boosting characteristic, respectively. The respective boosting characteristics indicate that the charging electric power shifts linearly in relation to the generated voltage.

In FIG. 9, line 162 denoting the twofold boosting characteristic intersects line 163 denoting the threefold boosting characteristic at a point where the generated voltage V61 is 0.833 V, and in FIG. 10, line 162 denoting the twofold boosting characteristic intersects line 163 denoting the threefold boosting characteristic at a point where the generated voltage V61 is 1.167 V. That is, the ratio of the generated voltage V61 to the stored voltage V71 (1 V and 1.4 V) at the point of intersection is 0.833/1 or 1.167/1.4, equal to 0.833 (=5/6), in both cases. This demonstrates that charging efficiency by twofold boosting is higher than that by threefold boosting when the generated voltage V61 moves upward from this point.

Similarly, line 162 denoting the twofold boosting characteristic intersects line 161 denoting the onefold boosting characteristic at a point where the generated voltage V61 is 1.5 V or 2.1 V, respectively. That is, the ratio of the generated voltage V61 to the stored voltage V71 at the point of intersection is 1.5/1 or 2.1/1.4, equal to 1.5 (=3/2), in both cases, demonstrating that charging efficiency by onefold boosting is higher than that by twofold boosting when the generated voltage V61 moves upward from the point of intersection. This can be said of a case where the stored voltage V71 varies.

For the reason evident from the foregoing description, the boosting ratio is set as follows in controlling the booster means 90 of the electronic watch according to the second embodiment.

For onefold boosting: 3/2≦generated voltage/stored voltage

For twofold boosting: 5/6≦generated voltage/stored voltage<3/2

For threefold boosting:1/3≦generated voltage/stored voltage<5/6 no boosting operation: generated voltage/stored voltage<1/3

By setting as above, a boosting ratio with high charging efficiency according to the ratio of the generated voltage V61 to the stored voltage V71 can be selected.

For the case of no boosting operation, the boosting ratio is set simply such that the threefold boosting characteristic does not assume negative values. This is because the extension of the straight line 163 of the threefold boosting characteristic shown by the broken line in FIGS. 9 and 10, respectively, crosses the horizontal axis of respective graphs at an intercept where the generated voltage V61 is 0.333 V and 0.465 V, respectively, representing a ratio of the generated voltage V61 to the stored voltage V71 (1 V and 1.4 V) at 0.33 (=1/3) in both cases.

However, with the booster means 90 described in the second embodiment, boosting voltages cannot be generated and held in the same way as in normal cases of application, and particularly during a period when the electric power storage means 30 is being charged. It is to be pointed out that this is due to the fact that the boosted output delivered by the booster means 90 is absorbed by the electric power storage means 30 so that an actually boosted voltage while the booster means 90 is in operation becomes substantially equivalent to the stored voltage V71, and the respective boosting capacitors 141, 142, and 143 shown in FIG. 7 operate at such terminal voltages as to maximize electric energy extracted from the electric power generator 10.

Accordingly, with the electronic watch according to the second embodiment, charging efficiency can be enhanced, particularly, in the initial stage of charging when the amount of stored electric energy is at a relatively low level.

Figure 11:
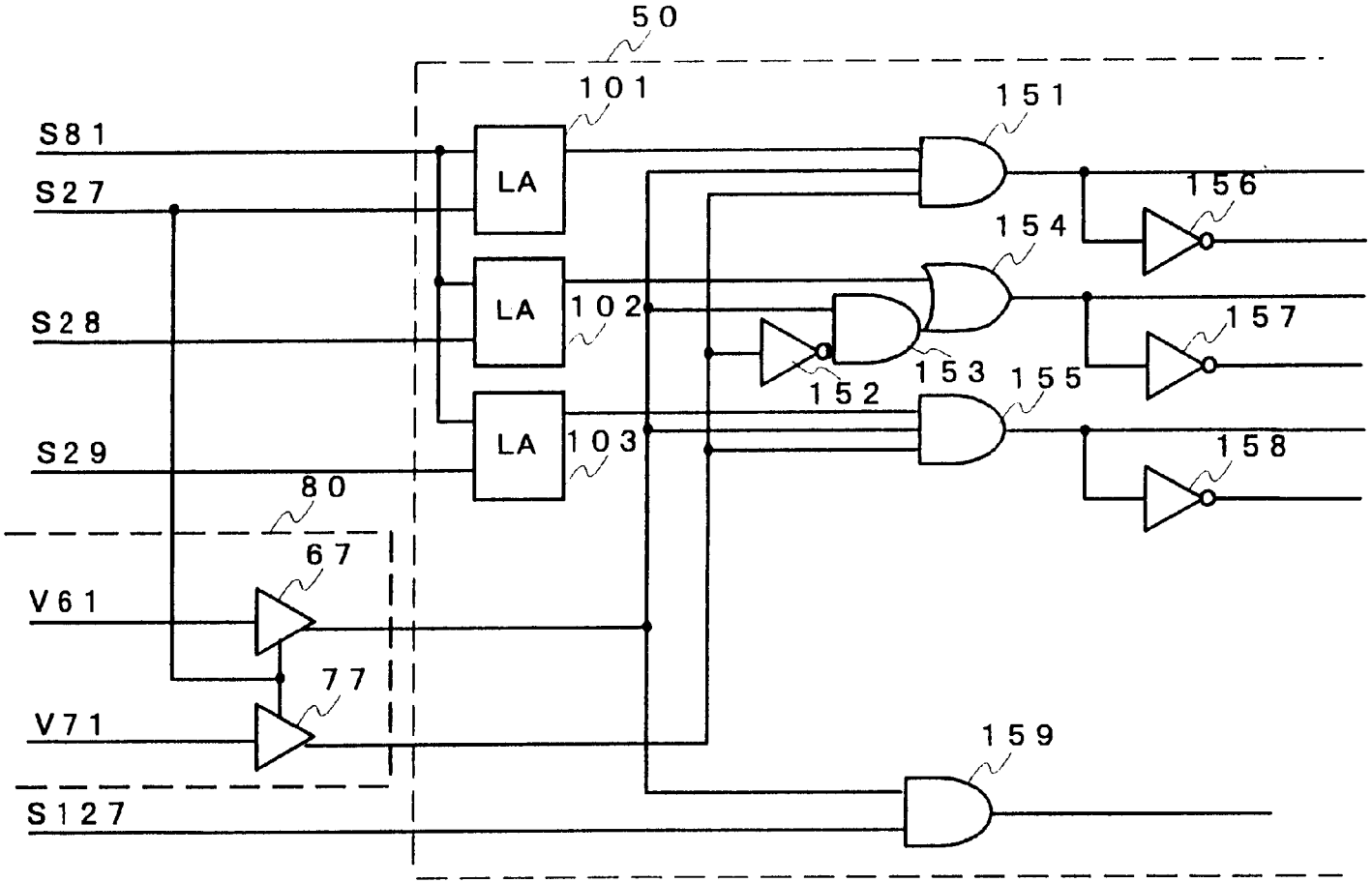
FIG. 11 is a circuit diagram showing only parts of arithmetic means and controller in a third embodiment of an electronic watch according to the invention.

Third Embodiment: FIG. 11

Next, a third embodiment of an electronic watch according to the invention is described with respect to only portions of the construction and operation thereof differing from the second embodiment, referring to a circuit diagram shown in FIG. 1. Since the third embodiment is the same as the second embodiment in respect of other portions, description of the other portions is omitted.

FIG. 11 is the circuit diagram showing portions of arithmetic means 80 as well as controller 50 in the electronic watch according to the third embodiment of the invention, and portions not shown are the same in construction as those of the second embodiment shown in FIG. 6.

The arithmetic means 80 is provided with an amplifier circuit as generated electric power detector 67 for outputting at the HIGH level if a generated voltage V61 is 0.6 V or higher to check whether or not the generated voltage V61 is not lower than a predetermined voltage, and also with another amplifier circuit as stored electric power detector 77 for outputting at the HIGH level if a stored voltage V71 is 0.6 V or higher to check whether or not the stored voltage V71 is not lower than a predetermined voltage.

In this connection, the amplifier circuits, that is, the generated electric power detector 67 and stored electric power detector 77 have a latching function, respectively, latching detection results on the rising edge of the onefold detection strobe S27.

Meanwhile, in the controller 50, first, second, and third latches, 101, 102, and 103, respectively, an eleventh AND gate 151, a third inverter 152, a twelfth AND gate 153, a fifth OR gate 154, a thirteenth AND gate 155, and fourth, fifth, and sixth inverters, 156, 157, and 158, respectively, form a circuit in place of the circuit formed by the first to third latches, 101, 101, and 103, respectively, in the controller 50 according to the second embodiment as shown in FIG. 6.

The first to third latches, 101, 102, and 103, are data latches, all of which receive an arithmetic output S81 from arithmetic means 80 as with the case of the data latches in the second embodiment, and the respective latches receive another input, that is, the first latch 101 receiving the onefold detection strobe S27, the second latch 102 a twofold detection strobe S28, and the third latch 103 a threefold detection strobe S29.

Then, an AND of an output of the first latch 101, that of the generated electric power detector 67, and that of the stored electric power detector 77 is outputted by AND gate 151 as a signal corresponding to the output of the third latch 103 in the second embodiment.

Further, an AND of the output of the generated electric power detector 67 and an inverting signal of the output of the stored electric power detector 77 is generated by the third inverter 152 and twelfth AND gate 153, and an OR of the AND and the output of the second latch 102 is generated by the fifth OR gate 154, outputting a signal corresponding to the output of the second latch 102 in the second embodiment.

Then, an AND of the output of the third latch 103, that of the generated electric power detector 67, and that of the stored electric power detector 77 is outputted by AND gate 155 as a signal corresponding to the output of the third latch 103 in the second embodiment.

Also, outputs of the eleventh AND gate 151, fifth OR gate 154, and thirteenth AND gate 155 are inverted by the fourth to sixth inverters, 156, 157, and 158, respectively, and outputted as signals corresponding to the respective inverting outputs of the first to third latches, 101, 102, and 103, in the second embodiment.

Further, an AND of a boost enable clock S127 and the output of the generated electric power detector 67 is generated by a fourteenth AND gate 159, and used as a signal corresponding to the boost enable clock S127 in the second embodiment.

Now an operation of the electronic watch according to the third embodiment is described hereinafter with reference to FIGS. 6 and 11. In normal operation, the third embodiment is substantially the same in operation as the second embodiment.

This is because when both the generated voltage V61 and the stored voltage V71 are in excess of 0.6 V, both the generated electric power detector 67 and the stored electric power detector 77 detect the onefold detection strobe S27 at the time of the same rising, and output at a HIGH level with the result that the output of the first to third latches, 101, 102, and 103, are reflected straight in the output of the eleventh AND gate 151, fifth OR gate 154, and thirteenth AND gate 155.

Now, description is made of an operation of the electronic watch when electric energy is stored in the electric power storage means 30 to some extent and the stored voltage V71 is on the order of 1.0 V while the generated voltage V61 is only on the order of 0.4 V.

In describing the operation for threefold boosting in the second embodiment previously described, mention has been made that voltage can be stepped up threefold if the generated voltage of the electric power generator 10 falls in the range between 0.67 V and 0.27 V when the terminal voltage of the electric power storage means 30 is on the order of 1.0 V. However, there are normally times when difficulties are encountered in efficiently boosting voltage threefold owing to the characteristics of the booster switches of the booster means 90 if the generated voltage is below, for example, 0.5 V.

In such a case, it is not only impossible to execute charging at a boosted voltage but also reverse discharge of electric energy stored in the electric power storage means 30 towards the booster means 90 will occur.

Accordingly, the electronic watch according to the third embodiment is set to execute the same operation as in the second embodiment when the generated voltage V61 is at 0.6 V or higher, but to inhibit charging operation when the generated voltage V61 is below 0.6 V.

More specifically, when the generated electric power detection means 67 latches the generated voltage V61 at the timing of the onefold detection strobe S27 rising, and an output therefrom turns to the LOW level, all the onefold signal S124 to threefold signal S126 turn to the LOW level irrespective of the boost enable signal S127, disabling a boosting charging operation.

Thus, by preventing such an operation as to discharge stored electric energy without avail when the generated voltage V61 is fairly low, the entire operation of the electronic watch can be stably controlled.

Conversely, when the terminal voltage of the electric power storage means 30 is low and the stored voltage V71 is, for example, on the order of 0.4 V, the controller 50 is set to control the booster means 90 at a onefold boosted voltage when the generated voltage V61 is 0.7 V in the case of the second embodiment, resulting in a possibility of a voltage as high as only about 0.7 V at most developing on the side of the clock means 20. This can disable the clock means 20, which generally requires a voltage on the order of 1.0 V for full operation, to perform a time display operation.

Accordingly, in the third embodiment, when both the generated voltage V61 and the stored voltage V71 are 0.6 V or higher, the same operation as in the second to embodiment is performed. However, particularly when the generated voltage V61 is 0.6 V or higher, and the stored voltage V71 is below 0.6 V, it is set that charging will be executed forcibly at a twofold boosted voltage.

More specifically, as a result of the generated voltage V61 and the stored voltage V71 being latched by the generated electric power detector 67 and the stored electric power detector 77, respectively, at the time that the onefold detection strobe S27 rises, the generated electric power detector 67 outputs at the HIGH level, and the stored electric power detector 77 outputs at the LOW level with the result that the eleventh AND gate 151 and thirteenth AND gate 155 output at the LOW level as one of inputs to the both gates turns to the LOW level, and only the twelfth AND gate 153 outputs at the HIGH level, rendering the output of the fifth OR gate 154 to go HIGH.

Hence, the operation inside the controller 50 becomes substantially same as the twofold boosting operation in the second embodiment described herinbefore, causing the booster means 90 to be forced to perform the twofold boosting operation.

As a result, upon receipt of the boosted voltage output, at least 1.2 V is secured at the terminal of the clock means 20, enabling the clock means 20 to continue the time display operation.

Thus, even when the stored voltage V71 is fairly low, interruption in the operation of the clock means 20 can be prevented, enabling the entire operation of the electronic watch to be controlled on a stable basis.

As is evident from the aforesaid description, the electronic watch according to the third embodiment can be operated on a stable basis even in a special case not presupposed to occur in the second embodiment, where the generated voltage V61 or the stored voltage V71 has declined to a very low level.

Fourth Embodiment

Finally, a fourth embodiment of an electronic watch according to the invention is described with reference to FIG. 12.

The fourth embodiment is substantially the same in construction as the second and third embodiments, and the construction of only differing portions thereof is described with reference to FIG. 12.

Figure 12:
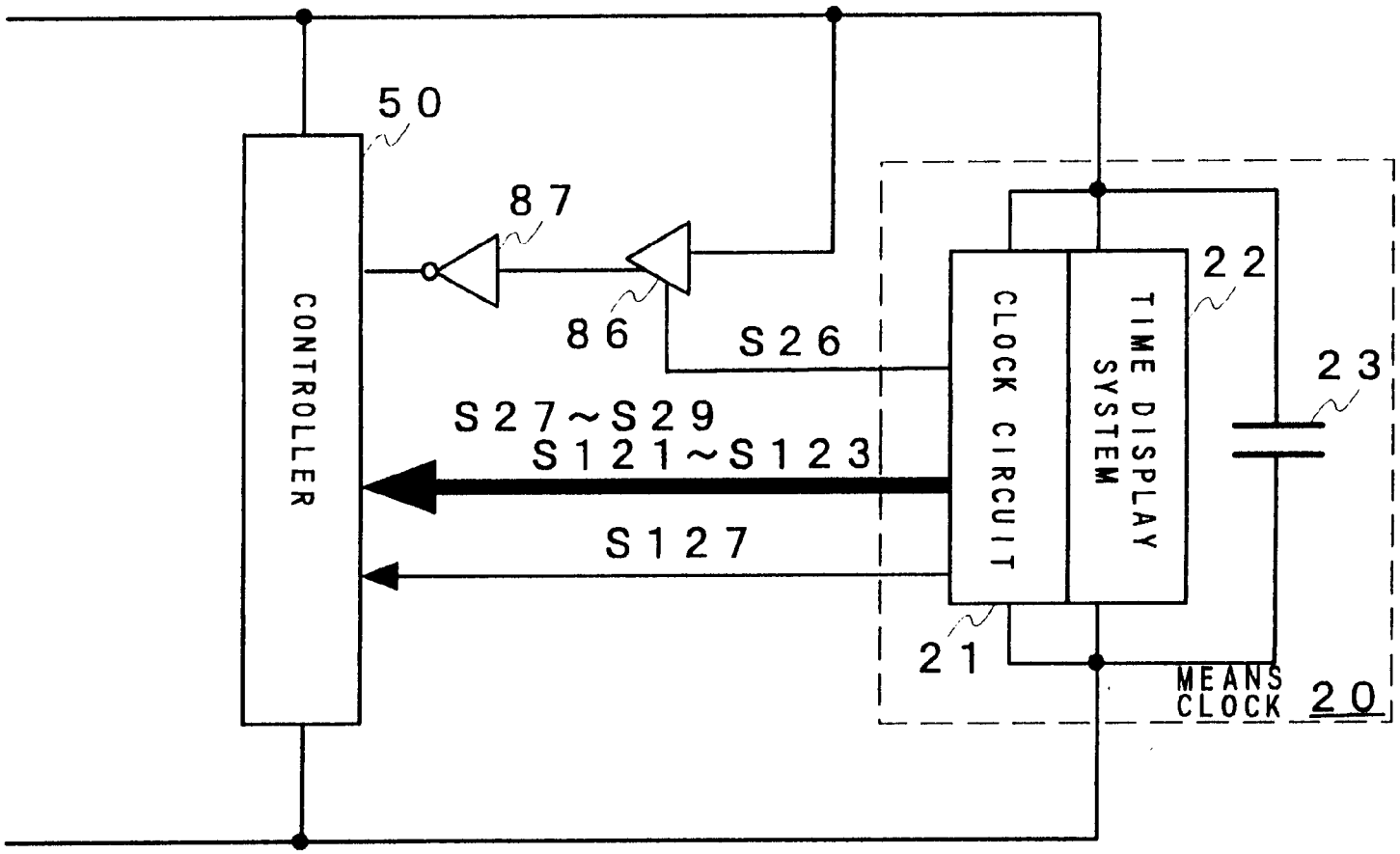
FIG. 12 is a circuit diagram showing only parts of an electronic watch according to a fourth embodiment of the invention, differing from the second embodiment.
Figure 13:
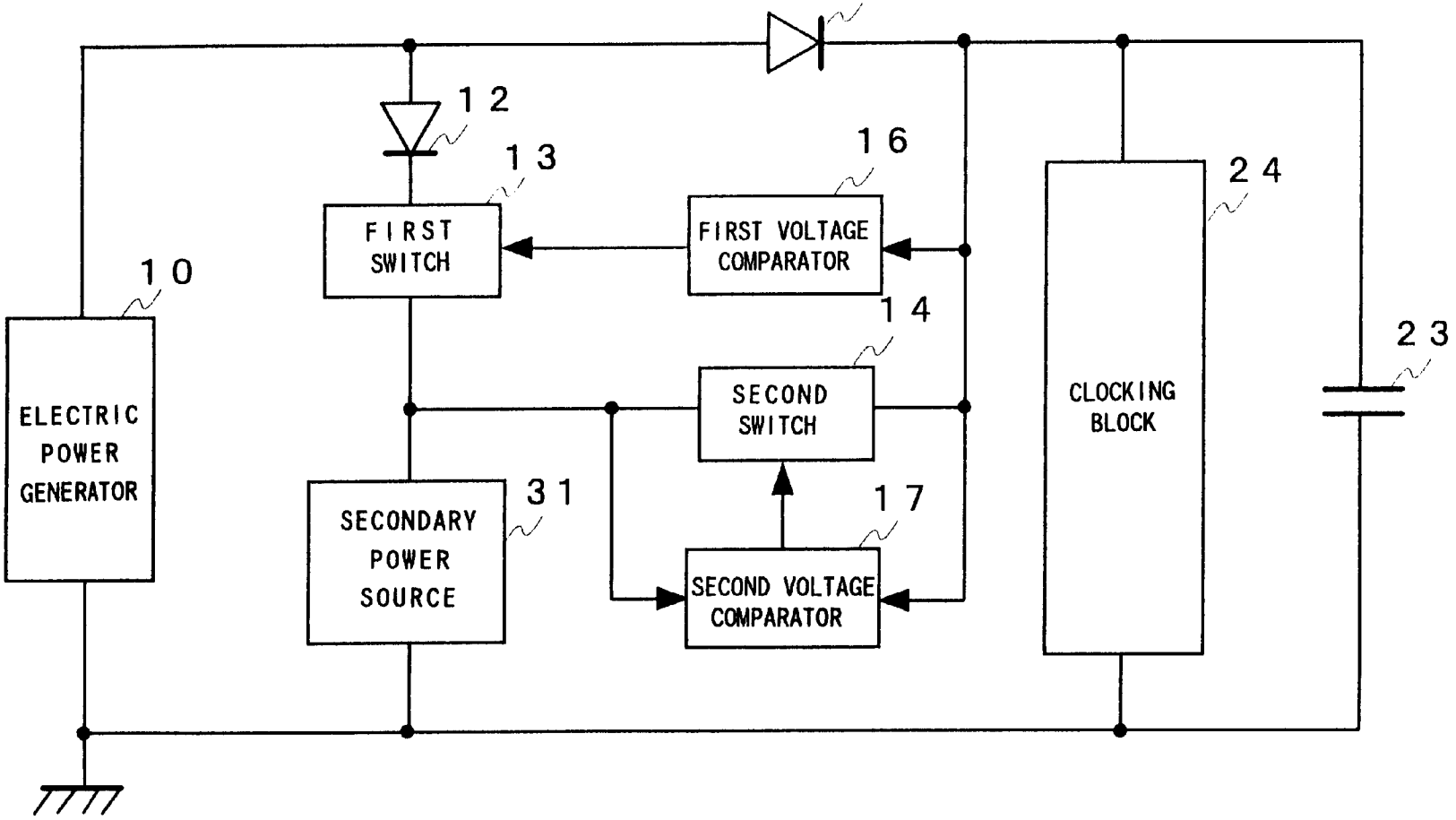
FIG. 13 PRIOR ART
FIG. 13 is a circuit diagram showing an example of the construction of a conventional electronic watch.

As shown in FIG. 12, the electronic watch according to the fourth embodiment is provided with an amplifier circuit functioning as a distribution detector 86 for outputting at the HIGH level if the positive terminal voltage of the clock means 20 is 1.2 V or higher in order to check whether or not the power source voltage of the clock means 20 is not lower than a predetermined voltage.

This amplifier circuit, that is, the distribution detector 86 has a latching function for latching detection results on the rising edge of the clock S26.

A signal generated by inverting an output of the distribution detector 86 through a seventh inverter 87 is outputted to controller 50 as a signal corresponding to the clock signal S26 in the second embodiment or third embodiment.

The operation of the electronic watch according to the fourth embodiment is described with reference to FIGS. 5 and 12.

The electronic watch according to the fourth embodiment is substantially the same in operation as the second or third embodiment previously described except for a distributive charging operation of switching circuit 40, achieving an improvement in respect of optimizing the driving of the clock means 20 and the charging of the electric power storage means 30.

More specifically, when the results of the distribution detector 86 detecting the power source voltage of the clock means 20 at the timing of the clock S26 in this embodiment, that is, at intervals of 0.5 second, instead of that of the clock signal S26 as in the second or third embodiment, indicate a voltage not lower than 1.2 V, a signal at the LOW level is delivered to the control means 50, and when the results indicate a voltage below 1.2 V, a signal at the HIGH level is delivered. This enables the control means 50 to control the switching means 40 by outputting first and second distribution signals S48, S49 such that a voltage boosted by booster means 90 can be delivered to the electric power storage means 30 only during a period when the power source voltage of the clock means 20 is maintained at a satisfactory level.

Thus, in the fourth embodiment, as opposed to the second or third embodiment wherein the electric power storage means 30 is charged periodically simply on a one to one time-sharing basis by use of the clock S26, time allocated for charging of the electric power storage means 30 can be varied according to changes in the power source voltage of the clock means 20 so that an amount of electric energy other than that required for driving the clock means 20 can be allocated for the charging of the electric power storage means 30.

Particularly, in the fourth embodiment, the power source voltage of the clock means 20 can be substantially stabilized close to a voltage detected by the distribution detector 86 by setting the frequency of the clock S26 appropriately, enabling a stepping motor used in common analog electronic watches to be driven stably as well.

Consequently, the driving of the clock means 20 and the charging of the electric power storage means 30 can be optimized causing neither excess nor deficiency in the amount of electric energy required for driving the clock means 20 even if there has been a change in the electric energy delivered from the electric energy generator 10, With reference to the second embodiment described hereinbefore, a method of dividing voltage by means of resistors is adopted in the first voltage divider 60 and second voltage divider 70. However, another method may also be adopted.

For example, a method of dividing voltage by means of two capacitors connected in series such that a capacitance ratio corresponds to a voltage division ratio, in place of resistors, may be adopted for tapping a divided voltage at an intermediate point therebetween. Further, if there is no restraint on electric current consumed at the time of dividing voltage, the voltage divider switches may be omitted.

Further, in the second embodiment, the first voltage divider 60, second voltage divider 70, and comparator 85 make up the arithmetic means 80. However, in the case where the ratio of the generated voltage to the stored voltage is directly calculated by use of a AD converter and microcomputer, the voltage dividers and comparator are no longer required, and the decoding part of the control means 50 is no longer required either.

The boosting ratio of the booster means 90 is determined according to the results of calculation executed by the arithmetic means 80, but particularly while the booster means 90 delivers a boosted output to the clock means 20, the boosting ratio can be set to a fixed value irrespective of the results of calculation executed by the arithmetic means 80.

For example, the boosting ratio for a duration of the booster means 90 delivering a boosted output to the clock means 20 may be fixedly set at twofold.

In the second to fourth embodiments described in the foregoing, the construction of the booster means 90 is assumed to be able to boost voltage by a factor of one, two, and three for brevity in the description, but the construction thereof is not limited thereto.

For example, booster means 90 having such a construction as to enable an operation to boost the voltage by a factor of 1.5, 2/3 (step-down by a factor of 3/2), and so forth may be adopted as necessary. Even in such a case, finer control of charging operation can be executed by making up arithmetic means or control means capable of selecting a boosting ratio according to the ratio of the generated voltage to the stored voltage as described above.

It is obvious from the aforesaid description that with the electronic watch according to the invention, the electric power storage means can be charged efficiently with electric energy generated by the electric power generator immediately or after boosting the voltage of the electric energy as long as the electric energy generated by the electric power generator is available to charge the electric power storage means regardless of conditions in the electric power generator and the electric power storage means.

Furthermore, in the case of charging after boosted voltage, the boosting operation can be executed by selecting such a boosting ratio as to be able to maximize charging efficiency.

Hence, it has become possible for the electronic watch according to the invention to make use of electric energy at a low voltage which has been difficult to do by means of the prior art, and particularly, to enhance charging efficiency in the initial stage of charging operation when the stored voltage of the electric power storage means is relatively low.

INDUSTRIAL UTILIZATION

The description given hereinbefore clearly shows that with the electronic watch according to the invention, provided with built-in electric power generator and electric power storage means, the efficiency of charging the electric power storage means can be enhanced, enabling stable clock operation thereof for a long duration. Particularly, if the booster means capable of boosting the generated voltage by a plurality of boosting ratios is provided and the boosting ratio is varied according to the ratio of the generated voltage to the stored voltage, optimum charging can be executed even when the generated voltage is fairly low. Accordingly, even with an electronic watch provided with built-in electric power generator whose generated voltage changes significantly due to the effect of the external environment, as represented by a thermoelectric device, charging can be executed highly efficiently, ensuring stable operation of the electronic watch for a long term.

What is claimed is:

1. An electronic watch comprising:

electric power generator for generating electric energy from external energy;

electric power storage means for storing the electric energy generated by said electric power generator;

clock means for executing time display operation by use of the electric energy supplied from said electric power generator or electric power storage means;

arithmetic means for calculating a ratio of a voltage generated by said electric power generator to a voltage of electric energy stored by said electric power storage means;

switching circuit for executing connection or disconnection among said electric power generator, electric power storage means, and clock means; and controller for controlling connection or disconnection within said switching circuit according to a arithmetic output delivered by said arithmetic means.

2. An electronic watch according to claim 1, characterized by said arithmetic means in which an operation to calculate the ratio of the voltage generated by said electric power generator to the voltage of the electric energy stored by said electric power storage means is intermittently executed.

3. An electronic watch according to claim 1, characterized by said controller having a function of controlling said switching circuit so as to cut off connection between said electric power generator and electric power storage means during calculating by said arithmetic means.

4. An electronic watch comprising:

electric power generator for generating electric energy from external energy;

electric power storage means for storing the electric energy generated by said electric power generator;

clock means for executing time display operation by use of electric energy supplied from said electric power generator or electric power storage means;

arithmetic means for calculating a ratio of a voltage generated by said electric power generator to a voltage of electric energy stored by said electric power storage means;

booster means for boosting the voltage generated by said electric power generator at any of a plurality of boosting ratios and supplying a boosted voltage to said electric power storage means and clock means;

switching circuit for executing connection or disconnection among said electric power generator, electric power storage means, clock means and booster means; and controller for controlling connection or disconnection within said switching circuit according to a arithmetic output delivered by said arithmetic means and controlling a boosting ratio of said booster means.

5. An electronic watch according to claim 4, characterized in that applied voltage detector for detecting a voltage applied to said clock means are provided, enabling said controller to control said switching circuit such that if the voltage applied is less than a predetermined voltage value, an output from said booster means is sent to said clock means, and if the voltage applied is more than a predetermined voltage value, an output from said booster means is sent to said electric power storage means.

6. An electronic watch according to claim 4, characterized in that said to control means is capable of controlling said booster means so as to select onefold boosting if the ratio of the voltage generated by said electric power generator to the voltage of the electric energy stored by said electric power storage means (voltage generated/voltage stored) is not less than 3/2, twofold boosting if the ratio is less than 3/2 but not less than 5/6, and threefold boosting if the ratio is less than 5/6 but not less than 1/3, respectively, a boosting operation being inhibited if the ratio is less than 1/3.

7. An electronic watch according to claim 4, characterized by said controller having a function of controlling said switching circuit such that during calculating by said arithmetic means and for a given period of time immediately before the calculating, the operation of said booster means is stopped, or connection between said electric power generator and booster means is cut off.

8. An electronic watch according to claim 4, characterized by said arithmetic means in which an operation to calculate the ratio of the voltage generated by said electric power generator to the voltage of the electric energy stored by said electric power storage means is intermittently executed.

9. An electronic watch according to claim 4, characterized by said controller having a function of controlling said switching circuit so as to cut off connection between said electric power generator and electric power storage means during calculating by said arithmetic means.

10. An electronic watch according to claim 4, characterized by said arithmetic means comprising:

first voltage divider for dividing the terminal voltage of said electric power generator at one or more voltage division ratios and outputting a first divided voltage;

second voltage divider for dividing the terminal voltage of said electric power storage means at one or more voltage division ratios and outputting a second divided voltage; and comparator for comparing magnitude of the output of said first voltage divider with that of said second voltage divider and outputting a comparison result.

11. An electronic watch comprising:

electric power generator for generating electric energy from external energy;

electric power storage means for storing the electric energy generated by said electric power generator;

clock means for executing time display operation by use of the electric energy supplied from said electric power generator or electric power storage means;

arithmetic means for calculating a ratio of a voltage generated by said electric power generator to a voltage of electric energy stored by said electric power storage means;

booster means for boosting the voltage generated by said electric power generator at any of a plurality of boosting ratios and supplying a boosted voltage to said electric power storage means and clock means;

switching circuit comprising a plurality of switching elements for executing connection or disconnection among said electric power generator, electric power storage means, clock means and booster means; and controller for controlling selection of a boosting ratio of said booster means according to an arithmetic output delivered by said arithmetic means, and for controlling said switching circuit such that if the voltage generated is lower than a predetermined voltage, a boosting operation by said booster means is forcibly stopped by nullifying operation or calculation results of said arithmetic means, and connection between said electric power generator and charging means is cut off.

12. An electronic watch according to claim 11, characterized by said arithmetic means in which an operation to calculate the ratio of the voltage generated by said electric power generator to the voltage of the electric energy stored by said electric power storage means is intermittently executed.

13. An electronic watch according to claim 11, characterized by said controller having a function of controlling said switching circuit so as to cut off connection between said electric power generator and electric power storage means during calculating by said arithmetic means.

14. An electronic watch according to claim 11, characterized by said controller having a function of controlling said switching circuit such that during calculating by said arithmetic means and for a given period of time immediately before the calculating, the operation of said booster means is stopped, or connection between said electric power generator and booster means is cut off.

15. An electronic watch comprising:

electric power generator for generating electric energy from external energy;

electric power storage means for storing the electric energy generated by said electric power generator;

clock means for executing time display operation by use of the electric energy supplied from said electric power generator or electric power storage means;

arithmetic means for calculating a ratio of a voltage generated by said electric power generator to a voltage of electric energy stored by said electric power storage means;

booster means for boosting the voltage generated by said electric power generator at any of a plurality of boosting ratios and supplying a boosted voltage to said electric power storage means;

switching circuit comprising a plurality of switching elements for executing connection or disconnection among said electric power generator, electric power storage means, clock means, and booster means; and controller for controlling selection of a boosting ratio of said booster means according to an arithmetic output delivered by said arithmetic means, and for controlling said switching circuit such that if the voltage generated is higher than a predetermined voltage and the voltage stored is lower than a predetermined voltage, the boosting ratio of said booster means is set at a fixed value by nullifying operation or calculation results of said arithmetic means, and said electric power storage means is charged at a boosted voltage.

16. An electronic watch according to claim 15, characterized in that the boosting ratio of said booster means, fixed by said controller, is a boosting ratio sufficient to develop a voltage enabling said clock means to be driven.

17. An electronic watch according to claim 4, characterized by said arithmetic means in which an operation to calculate the ratio of the voltage generated by said electric power generator to the voltage of the electric energy stored by said electric power storage means is intermittently executed.

18. An electronic watch according to claim 6, characterized by said controller having a function of controlling said switching circuit so as to cut off connection between said electric power generator and electric power storage means during calculating by said arithmetic means.

19. An electronic watch according to claim 6, characterized by said controller having a function of controlling said switching circuit such that during calculating by said arithmetic means and for a given period of time immediately before the calculating, the operation of said booster means is stopped, or connection between said electric power generator and booster means is cut off.

* * * * *

UNITED STATES PATENT AND TRADEMARK OFFICE

CERTIFICATE OF CORRECTION

PATENT NO.: 6,069,846
DATED : May 30, 2000
INVENTOR(S): Yoichi NAGATA

It is certified that error appears in the above-identified patent and that said Letters Patent is hereby corrected as shown below:

IN THE CLAIMS:

Please amend claims 17 - 19 as follows:

Claim 17, line 1, change "4" to --15--.

Claim 18, line 1, change "6" to --15--.

Claim 19, line 1, change "6" to --15--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*